US008374536B2

(12) United States Patent
Baba et al.

(10) Patent No.: US 8,374,536 B2
(45) Date of Patent: Feb. 12, 2013

(54) CYLINDRICAL HEATING ROTATOR FOR HEATING A DEVELOPER, FIXING DEVICE USING SAID HEATING ROTATOR AND IMAGE FORMING DEVICE USING SAID HEATING ROTATOR

(75) Inventors: Motofumi Baba, Ebina (JP); Yasuhiro Uehara, Ebina (JP); Hiroshi Oikawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 439 days.

(21) Appl. No.: 12/718,770

(22) Filed: Mar. 5, 2010

(65) Prior Publication Data

US 2010/0239339 A1 Sep. 23, 2010

(30) Foreign Application Priority Data

Mar. 23, 2009 (JP) ..... 2009-070874

(51) Int. Cl.
*G03G 15/20* (2006.01)

(52) U.S. Cl. ..... 399/333

(58) Field of Classification Search ..... 399/328, 399/329, 330, 333; 219/216; 492/18
See application file for complete search history.

(56) References Cited

U.S. PATENT DOCUMENTS 6,636,718 B2 * 10/2003 Yura et al. ..... 399/333

FOREIGN PATENT DOCUMENTS

| | | | |
|---|---|---|---|
| JP | 10-166100 | A | 6/1998 |
| JP | 11-189022 | A | 7/1999 |
| JP | 2003-28143 | A | 1/2003 |
| JP | 2004-246016 | A | 9/2004 |
| JP | 3738615 | A | 1/2006 |

* cited by examiner

*Primary Examiner* — William J Royer
(74) *Attorney, Agent, or Firm* — Sughrue Mion, PLLC

(57) ABSTRACT

A heating rotator that is used for heating a developer on a recording medium has a cylindrical body that is made of a metal and both end portions of the cylindrical body is rotatably supported. The cylindrical body has a thick-walled portion at both end portions that is thicker than a center portion in an axial direction of the cylindrical body, and a cross-sectional shape of the heating rotator changes from the end portions toward the center portion in a pressure area of an outer peripheral surface to which pressure is applied by a pressure rotator.

16 Claims, 17 Drawing Sheets

CROSS SECTION A-A'

CROSS SECTION B-B'

CROSS SECTION C-C'

CROSS SECTION D-D'

CROSS SECTION E-E'

CROSS SECTION F-F'

CROSS SECTION G-G'

CROSS SECTION H-H'

CROSS SECTION J-J'

CROSS SECTION K-K'

CYLINDRICAL HEATING ROTATOR FOR HEATING A DEVELOPER, FIXING DEVICE USING SAID HEATING ROTATOR AND IMAGE FORMING DEVICE USING SAID HEATING ROTATOR

CROSS-REFERENCE TO RELATED APPLICATION

This application is based on and claims priority under 35 USC §119 from Japanese Patent Application No. 2009-070874 filed on Mar. 23, 2009.

BACKGROUND

1. Technical Field

The invention relates to a heating rotator, a fixing device and an image forming device.

2. Related Art

Conventionally, there have been fixing devices for melting developer images by action of heat and pressure to fix the same by allowing recording paper to which the developer images are transferred to pass through pressure areas formed of the heating rotators heated by heat sources and pressure rotators.

SUMMARY

A first aspect of the present invention is a heating rotator that is used for heating a developer on a recording medium, the heating rotator including a cylindrical body that is made of a metal and both end portions of the cylindrical body being rotatably supported, the cylindrical body having a thick-walled portion at both end portions that is thicker than a center portion in an axial direction of the cylindrical body, and a cross-sectional shape of the heating rotator changing from the end portions toward the center portion in a pressure area of an outer peripheral surface to which pressure is applied by a pressure rotator.

BRIEF DESCRIPTION OF THE DRAWINGS

Exemplary embodiments of the present invention will be described in detail based on the following figures, wherein.

DETAILED DESCRIPTION

A heating rotator, a fixing device and an image forming device in accordance with the first exemplary embodiment of the invention will be described with reference to the drawings.

Figure 1:
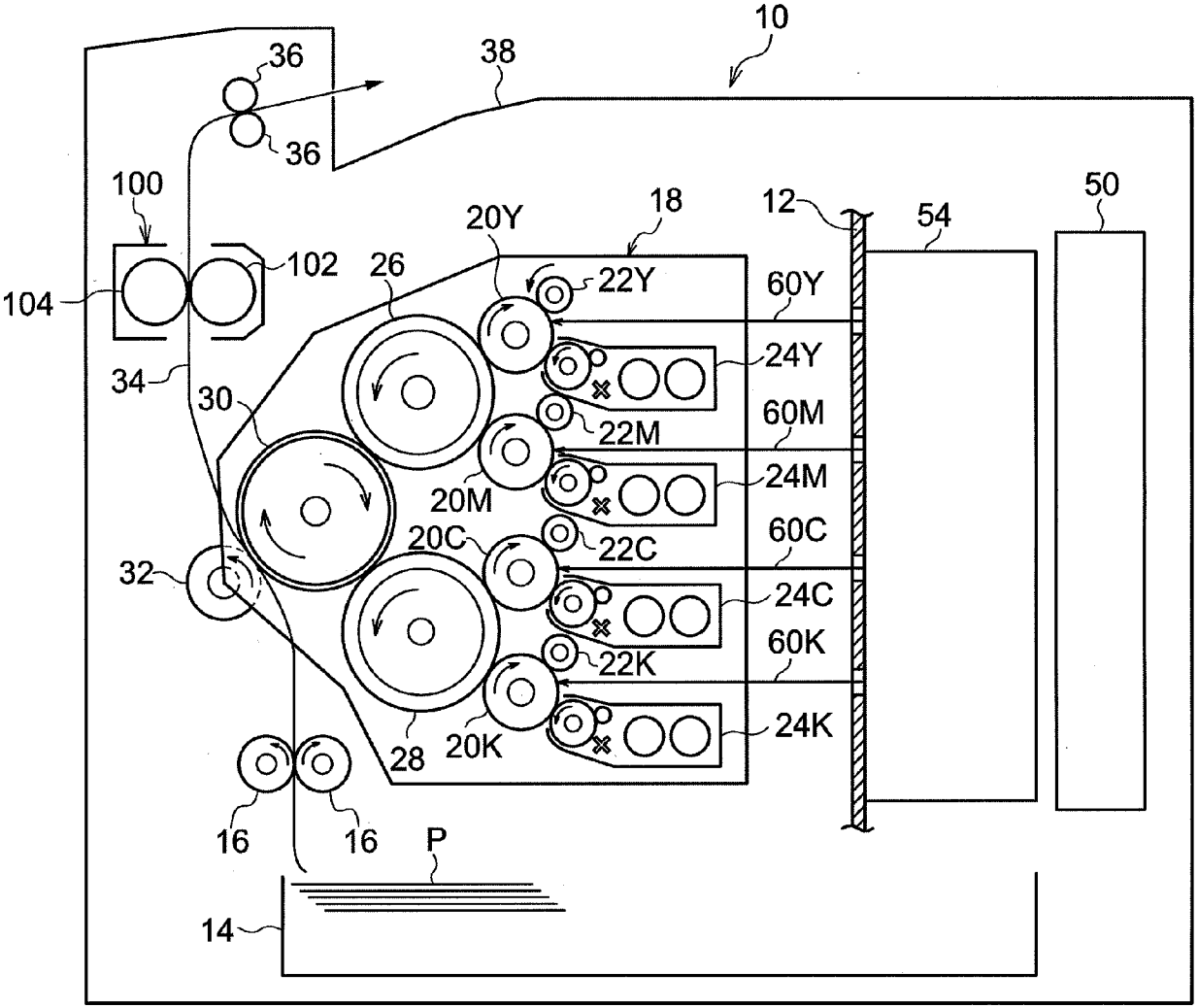
FIG. 1 is an overall view of an image forming device according to a first exemplary embodiment of the invention.

FIG. 1 illustrates a printer 10 as the image forming device. In the printer 10, an optical scanning device 54 is fixed to a casing 12, which configures a main body of the printer 10, and a control unit 50 for controlling operation of the optical scanning device 54 and each unit of the printer 10 is provided on a position adjacent to the optical scanning device 54.

The optical scanning device 54 is configured to scan a light beam emitted from a light source not illustrated by a rotating polygon mirror and reflect the same by plural optical components such as a reflection mirror to emit light beams 60Y, 60M, 60C and 60K corresponding to each developer (toner) of yellow (Y), magenta (M), cyan (C) and black (K). The light beams 60Y, 60M, 60C and 60K are guided to corresponding photoreceptors 20Y, 20M, 20C and 20K, respectively.

A paper accommodating unit 14 for accommodating recording paper P is provided on a lower portion of the printer 10. A pair of registration rolls 16 for adjusting a tip end position of the recording paper P to be conveyed are provided above the paper accommodating unit 14. Also, an image forming unit 18 is provided on a center of the printer 10. The image forming unit 18 is provided with the four photoreceptors 20Y, 20M, 20C and 20K vertically arranged in line.

Charging rollers 22Y, 22M, 22C and 22K for charging surfaces of the photoreceptors 20Y, 20M, 20C and 20K are provided on upstream sides in a rotational direction of the photoreceptors 20Y, 20M, 20C and 20K, respectively. Also, developing devices 24Y, 24M, 24C and 24K for developing each toner of Y, M, C and K on the photoreceptors 20Y, 20M, 20C and 20K are provided on downstream sides in the rotational direction of the photoreceptors 20Y, 20M, 20C and 20K, respectively.

On the other hand, a first intermediate transfer body 26 contacts the photoreceptors 20Y and 20M and a second intermediate transfer body 28 contacts the photoreceptors 20C and 20K. A third intermediate transfer body 30 contacts the first intermediate transfer body 26 and the second intermediate transfer body 28. A transfer roll 32 is provided on a position opposed to the third intermediate transfer body 30, the recording paper P is conveyed between the transfer roll 32 and the third intermediate transfer body 30, and a developer image (toner image) on the third intermediate transfer body 30 is transferred to the recording paper P.

A fixing device 100 is provided on a downstream side of a paper conveyance path 34 on which the recording paper P is conveyed. The fixing device 100 has a heating rotator 102 and a pressure roll 104 for heating and pressurizing the recording paper P to fix the toner image on the recording paper P. The recording paper P, on which the toner image is fixed, is conveyed by paper conveyance rolls 36 provided on a downstream side of the paper conveyance path 34 to be discharged into an accumulating unit 38 provided at an upper portion of the printer 10.

Image formation by the printer 10 will now be described.

When the image formation is started, the surfaces of the photoreceptors 20Y, 20M, 20C and 20K are uniformly charged by the charging rollers 22Y, 22M, 22C and 22K, respectively. Then, the charged surfaces of the photoreceptors 20Y, 20M, 20C and 20K are irradiated with the light beams 60Y, 60M, 60C and 60K corresponding to an output image from the optical scanning device 54, and electrostatic latent images corresponding to each color separated image are formed on the photoreceptors 20Y, 20M, 20C and 20K. The developing devices 24Y, 24M, 24C and 24K selectively apply the toners of each color, that is to say, Y, M, C and K, to the electrostatic latent images, and the toner images of the colors of Y, M, C and K are formed on the photoreceptors 20Y, 20M, 20C and 20K, respectively.

Thereafter, the magenta toner image is primarily transferred from the photoreceptor 20M for magenta to the first intermediate transfer body 26. Also, the yellow toner image is primarily transferred from the photoreceptor 20Y for yellow to the first intermediate transfer body 26 to be superimposed on the magenta toner image on the first intermediate transfer body 26.

On the other hand, the black toner image is primarily transferred similarly from the photoreceptor 20K for black to the second intermediate transfer body 28. Also, the cyan toner image is primarily transferred from the photoreceptor 20C for cyan to the second intermediate transfer body 28 to be superimposed on the black toner image on the second intermediate transfer body 28.

The magenta and yellow toner images primarily transferred to the first intermediate transfer body 26 are secondarily transferred to the third intermediate transfer body 30. On the other hand, the black and cyan toner images primarily transferred to the second intermediate transfer body 28 are secondarily transferred to the third intermediate transfer body 30. The magenta and yellow toner images secondarily transferred previously are superimposed on the cyan and black toner images to form a full-color toner image of color (three colors) and black on the third intermediate transfer body 30.

The secondarily transferred full-color toner image reaches a nip portion between the third intermediate transfer body 30 and the transfer roll 32. In synchronization with this timing, the recording paper P is conveyed from the registration rolls 16 to the nip portion and the full-color toner image is tertiarily transferred (finally transferred) to the recording paper P.

The recording paper P is thereafter sent to the fixing device 100 and passes through a pressure area S (see FIG. 7A) where the heating rotator 102 contacts the pressure roll 104. At that time, the full-color toner image is fixed on the recording paper P by action of heat and pressure applied by the heating rotator 102 and the pressure roll 104. After the fixation, the recording paper P is conveyed by the paper conveyance rolls 36 to be discharged into the accumulating unit 38 and full-color image formation on the recording paper P is terminated.

The fixing device 100 according to the first exemplary embodiment will be described below.

Figure 2:
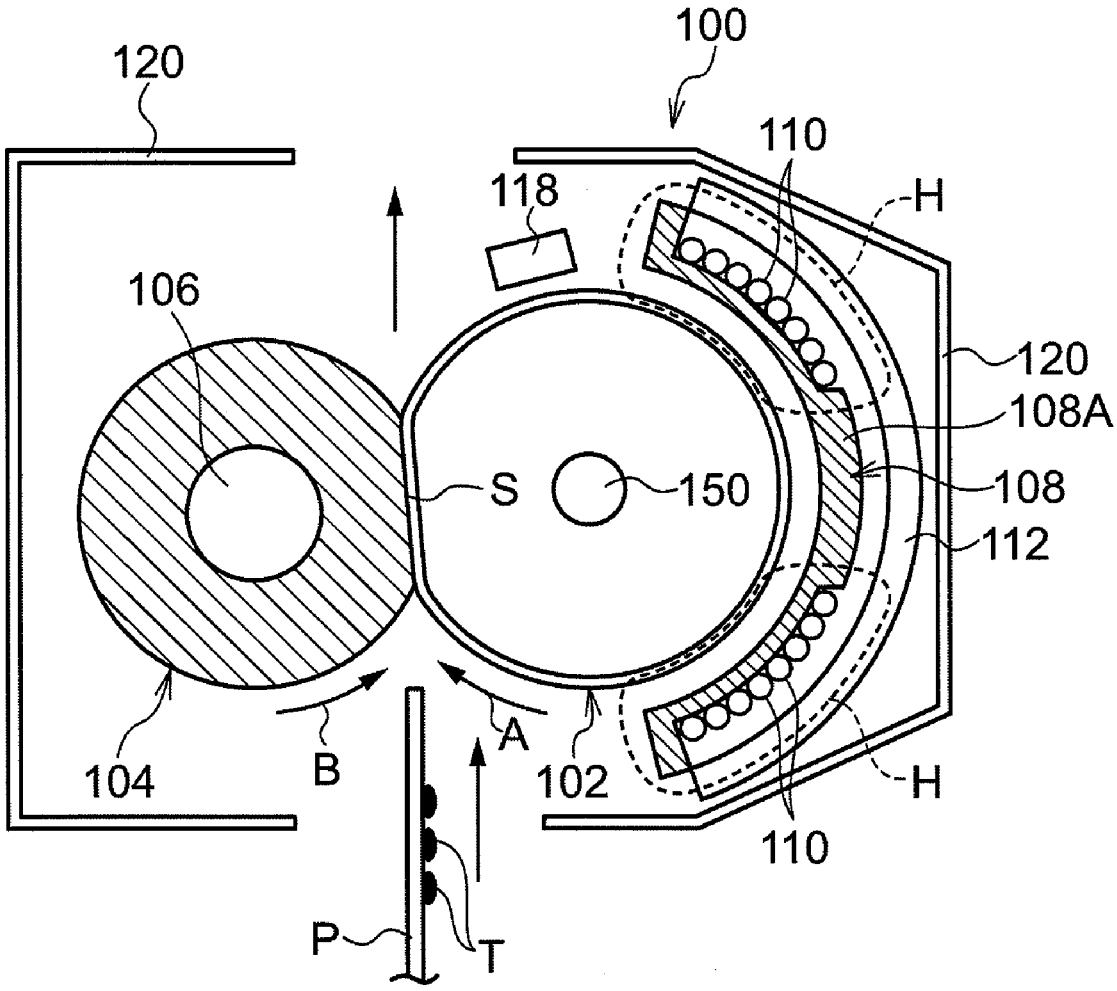
FIG. 2 is a cross-sectional view of a fixing device according to the first exemplary embodiment of the invention.

As illustrated in FIG. 2, the fixing device 100 is provided with a casing 120 on which openings for allowing the recording paper P to enter and exit are formed. An endless heating rotator 102, which rotates in a direction of an arrow A, is provided inside the casing 120.

A bobbin 108 configured of an insulating material is arranged at a position opposed to an outer peripheral surface of the heating rotator 102. The bobbin 108 is formed in a substantially circular arc shape conforming with the outer peripheral surface of the heating rotator 102, and a convex portion 108A is provided at a substantially center portion of a surface opposite to the heating rotator 102 in a protruding manner. A distance between the bobbin 108 and the heating rotator 102 is set to approximately 1 to 3 mm.

An excitation coil 110 for generating a magnetic field H by energization is wound plural times onto the bobbin 108 around the convex portion 108A in an axial direction (depth direction of a plane of paper of FIG. 2). Also, a magnetic body core 112 formed in a substantially circular arc shape conforming with the circular arc shape of the bobbin 108 is arranged on a position opposite to the bobbin 108 and opposed to the excitation coil 110 to be supported by the bobbin 108.

On the other hand, the pressure roll 104 driven to rotate in a direction of an arrow B with respect to the rotation of the heating rotator 102 is pressure-contacted to the outer peripheral surface of the heating rotator 102. A length in an axial direction of the pressure roll 104 is shorter than that of the heating rotator 102. Also, a load acting on the pressure area S where the heating rotator 102 contacts the pressure roll 104 is set to 15 to 20 kgf, and this is set to 20 kgf in this exemplary embodiment.

Also, the pressure roll 104 is structured by providing a foamed silicon rubber sponge elastic layer of 5 mm thickness around a metal core 106 made of metal such as aluminum and covering an outer side of the foamed silicon rubber sponge elastic layer with a release layer made of PFA including carbon of 50 μm thickness. As the sponge elastic layer provided around the metal core 106, the one having plural through-holes penetrating in a longitudinal direction of the metal core 106 may be used, for example.

A non-contact temperature sensor 118 for measuring a temperature of the surface of the heating rotator 102 is provided at the surface of the heating rotator 102 in an area which is not opposed to the excitation coil 110 and an area on a discharge side of the recording paper P. An installation position of the temperature sensor 118 is set to be at a substantially center portion in an axial direction (depth direction of the plane of paper of FIG. 2) of the heating rotator 102 such that a measured value does not change depending on a width of the recording paper P.

Figure 5:
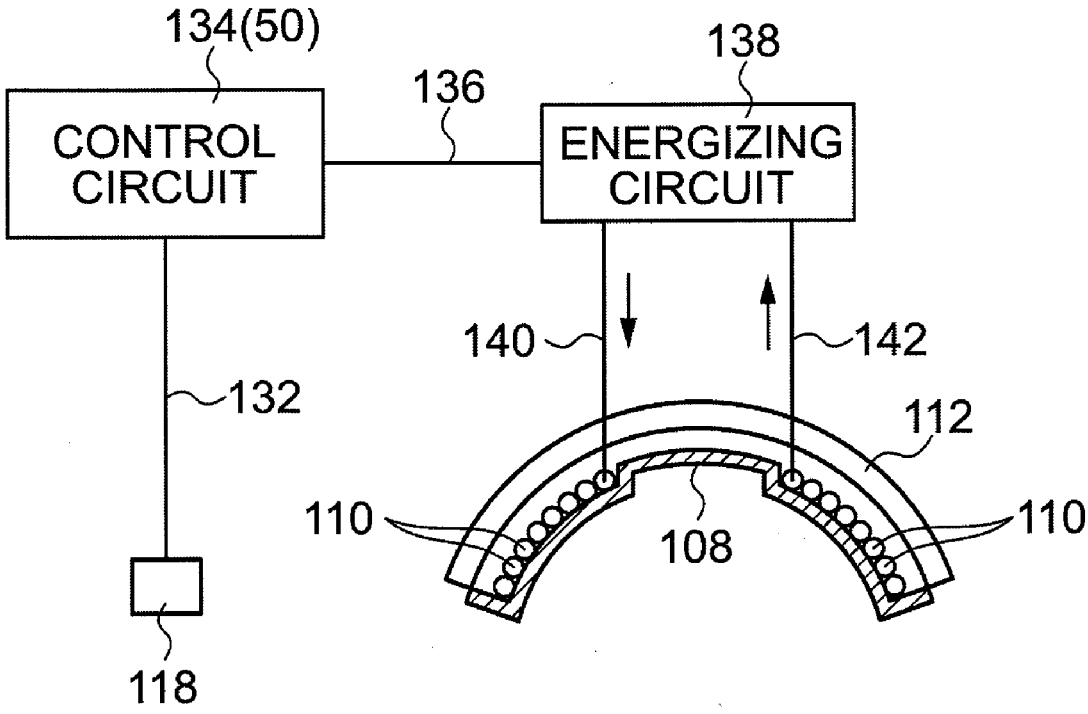
FIG. 5 is a connection diagram of a control circuit and an energizing circuit according to the first exemplary embodiment of the invention.

As illustrated in FIG. 5, the temperature sensor 118 is connected to a control circuit 134 provided inside the control unit 50 (see FIG. 1) via a wire 132. Also, the control circuit 134 is connected to an energizing circuit 138 via a wire 136, and the energizing circuit 138 is connected to the excitation coil 110 via wires 140 and 142. The energizing circuit 138 is configured to be driven or stopped based on an electric signal transmitted from the control circuit 134 to supply (in a direction of an arrow) or stop supplying an alternating current to the excitation coil 110 via the wires 140 and 142.

The control circuit 134 measures the temperature of the surface of the heating rotator 102 based on an amount of electricity transmitted from the temperature sensor 118 and compares the measured temperature with a preset fixing temperature stored in advance (170 degrees C. in this exemplary embodiment). When the measured temperature is lower than the preset fixing temperature, the energizing circuit 138 is driven to energize the excitation coil 110 and the magnetic field H (see FIG. 2) as a magnetic circuit is generated. When the measured temperature is higher than the preset fixing temperature, the energizing circuit 138 is stopped.

A configuration of the heating rotator 102 will be described below.

Figure 3A:
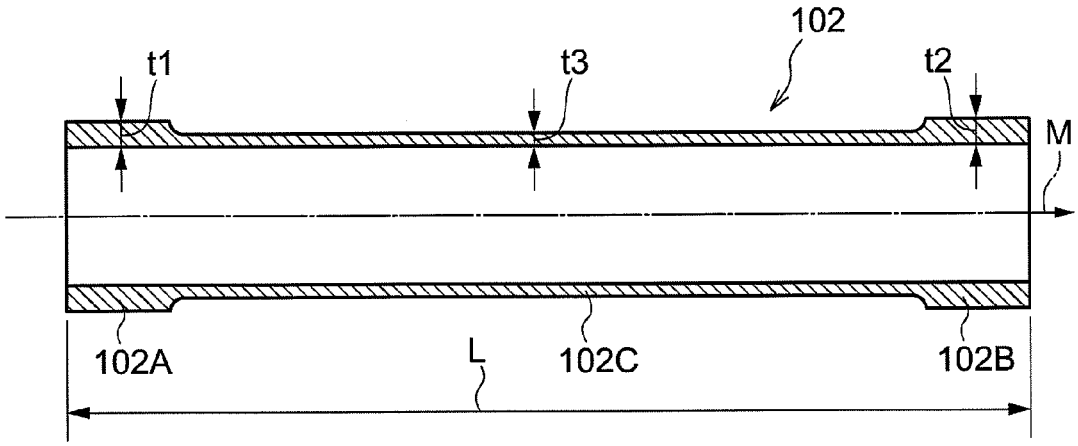
FIG. 3A is a cross-sectional view in an axial direction of a heating rotator according to the first exemplary embodiment of the invention.

As illustrated in FIG. 3A, the heating rotator 102 is a hollow cylindrical body in which outer diameters of both ends (end portions) 102A and 102B in the axial direction (direction of an arrow M) are larger than an outer diameter of a center portion 102C, and inner diameters of both end portions 102A and 102B are substantially the same as that of the center portion 102C. Therefore, thicknesses t1 and t2 of both end portions 102A and 102B of the heating rotator 102 are larger than a thickness t3 of the center portion 102C, and both end portions 102A and 102B of the heating rotator 102 are thick-walled portions, which are convex outward.

Also, a length L in the axial direction of the heating rotator 102 is set to 300 mm. Lengths of both end portions 102A and 102B in the axial direction of the heating rotator 102, which are determined based on the width of the recording paper P (see FIG. 2) on which the fixation is performed, are preferably set to 30 to 40 mm, and they are set to 30 mm. The diameter of the center portion 102C is preferably set to 26 to 30 mm, and this is set to 30 mm.

Figure 3B:
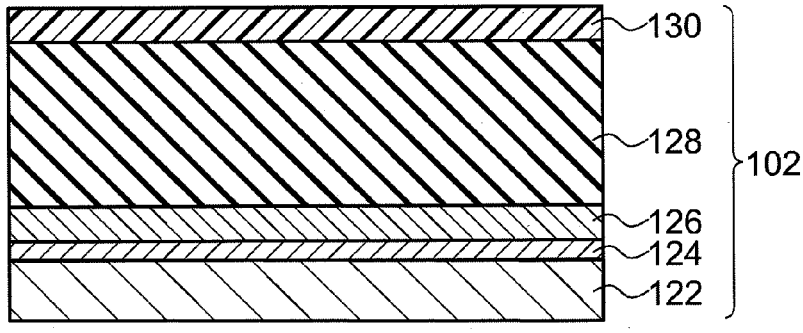
FIG. 3B is a cross-sectional view illustrating a layer configuration of the heating rotator according to the first exemplary embodiment of the invention.

As illustrated in FIG. 3B, the heating rotator 102 is configured of a base layer 122, a heat generating layer 124, a protecting layer 126, an elastic layer 128 and a release layer 130 from an inner side to an outer side in a radial direction thereof, and they are stacked to be integral with one another.

As illustrated in FIGS. 3A and 3B, there is difference in thickness between both end portions 102A and 102B and the center portion 102C of the heating rotator 102, because thicknesses of the base layer 122, the heat generating layer 124 and the protecting layer 126 are different in both end portions 102A and 102B and in the center portion 102C. The thicknesses t1 and t2 of the base layer 122, the heat generating layer 124 and the protecting layer 126 in both end portions 102A and 102B of the heating rotator 102 are identical to each other, and they are preferably set to 0.5 mm to 1.0 mm. Therefore, it is set that t1=t2=1.0 mm.

On the other hand, the thickness t3 of the base layer 122, the heat generating layer 124 and the protecting layer 126 in the center portion 102C is preferably set to 70 μm to 200 μm. Therefore, t3 is set to 90 μm. The thicknesses of the elastic layer 128 and the release layer 130 are substantially the same in the axial direction.

The base layer 122 serves as a base for maintaining strength of the heating rotator 102 and is configured of non-magnetic stainless steel. In the base layer 122, metal such as iron, nickel, chrome, silicon, boron, niobium, copper, zirconium and cobalt, or a metal material such as an alloy of them and a multilayer clad metal configured of them may be used other than steel and stainless steel. In a case of the multilayer clad metal, the one configured of at least two layers of different types of metal including the heat generating layer 124 may be selected.

The heat generating layer 124 is configured of the metal material, which generates heat by electromagnetic induction action in which an eddy current flows, so as to generate a magnetic field, which counters the magnetic field H (see FIG. 2), and the metal material such as gold, silver, copper, aluminum, zinc, tin, lead, bismuth, beryllium and antimony or an alloy of them may be used, for example. In this exemplary embodiment, copper is used as the heat generating layer 124 from a viewpoint of efficiently obtaining a required amount of heat generation by setting an intrinsic resistance to $2.7\times10^{-8}$ Ωcm or less, and of a low cost.

Also, the smaller a heat capacity is, the shorter a warm-up time (time until fixing operation becomes possible) of the fixing device 100 may be, so that it is desirable that a layer as thin as possible is provided as the heat generating layer 124. In a case of the non-magnetic metal, the layer having a thickness of 2 μm to 20 μm may produce heat, and the thickness of the heat generating layer 124 is set to 10 μm in this exemplary embodiment.

A material and a thickness of the protecting layer 126 are determined from a viewpoint that the layer does not interrupt the magnetic field H (see FIG. 2) and this does not inhibit heat generating efficiency of the heat generating layer 124 or this is resistant to oxidation (rust) and corrosion, and in this exemplary embodiment, the protecting layer 126 is configured of non-magnetic stainless (intrinsic resistance is 60 to $80\times10^{-8}$ Ωm) and the thickness thereof is set to 30 μm. The base layer 122, the heat generating layer 124 and the protecting layer 126 are integrally formed to be a seamless tube made of clad steel.

Silicon rubber or fluorinated-rubber is used as the elastic layer 128 from a viewpoint of obtaining excellent elasticity and heat resistance, and the silicon rubber is used in this exemplary embodiment. Also, the thickness of the elastic layer 128 is set to 200 μm in this exemplary embodiment.

The release layer 130 is provided so as to reduce adhesive force with toner T (see FIG. 2) melted on the recording paper P to allow the recording paper P to be easily separated from the heating rotator 102. In order to obtain excellent surface separability, a fluorine resin, a silicon resin or a polyimide resin is preferably used as the release layer 130, and tetrafluoroethylene-perfluoro alkoxy vinyl ether copolymer (PFA) is used in this exemplary embodiment. The thickness of the release layer 130 is set to 30 μm in this exemplary embodiment.

The invention does not require a member to receive pressure applied from the pressure roll 104 inside the heating rotator 102 when the recording paper P is fixed by pressurizing the heating rotator 102 against the pressure roll 104. Therefore, sliding resistance is not generated on an inner peripheral surface of the heating rotator 102, and heat is less deprived from the heating rotator 102. In the heating rotator 102 of the invention, a surface pressure of the pressure area when pressure of 15 kgf to 20 kgf is applied is 0.5 kgf/cm$^2$ even when there is no member to receive the pressure, and fixing performance is maintained.

A method of manufacturing the heating rotator 102 will be described below.

Figure 4A:
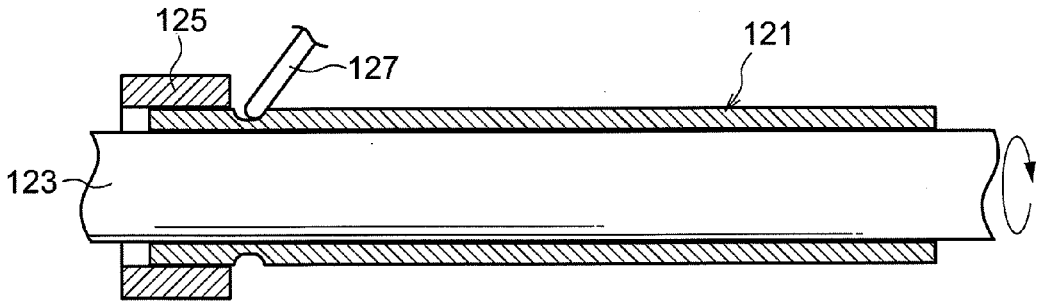
FIGS. 4A to 4C are process charts illustrating a method of manufacturing the heating rotator according to the first exemplary embodiment of the invention.

As illustrated in FIG. 4A, a seamless tube 121 made of the clad steel obtained by integrating the base layer 122, the heat generating layer 124 and the protecting layer 126 (see FIG. 3B) is first formed. Then, a rotating shaft 123 of a fabricating device (not illustrated) is inserted into the seamless tube 121, and a fixing jig 125 is inserted onto a first end (end portion) of the seamless tube 121 to fix the seamless tube 121. The rotating shaft 123 is rotated in this state to rotate the seamless tube 121.

Figure 4B:
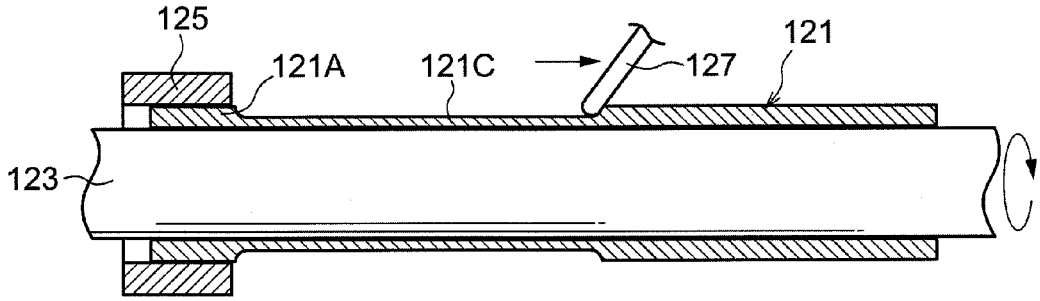

Subsequently, as illustrated in FIG. 4B, a spatula 127 is brought into contact with an outer peripheral surface of a first end of the seamless tube 121 in a state in which the seamless tube 121 rotates, and this is moved in an axial direction of the rotating shaft 123 to apply spinning. Therefore, a thick-walled portion 121A and a thin-walled portion 121C are formed on the seamless tube 121.

Figure 4C:
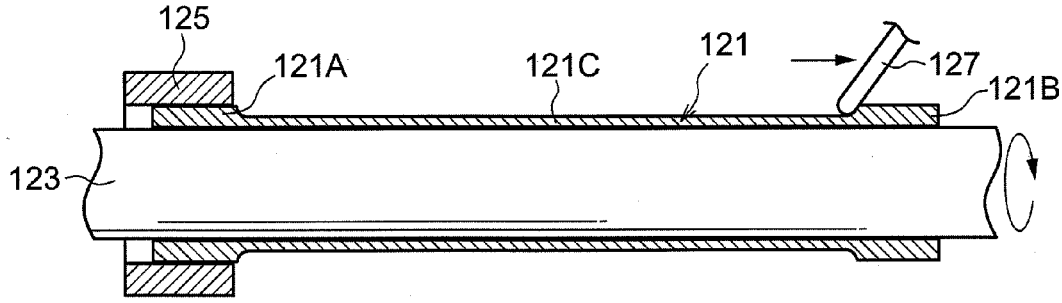

Subsequently, as illustrated in FIG. 4C, the spatula 127 is further moved to broaden an area of the thin-walled portion 121C, and thereafter, the spatula 127 is removed from the seamless tube 121 and the rotation of the rotating shaft 123 is stopped. Therefore, a thick-walled portion 121B is formed on a second end (end portion) of the seamless tube 121.

Subsequently, the outer peripheral surface of the seamless tube 121 is covered with the elastic layer 128 and the release layer 130 (see FIG. 3B). In this manner, the heating rotator 102 is formed.

A cross-sectional state of the heating rotator 102 and the pressure roll 104 will be described below.

Figure 6A:
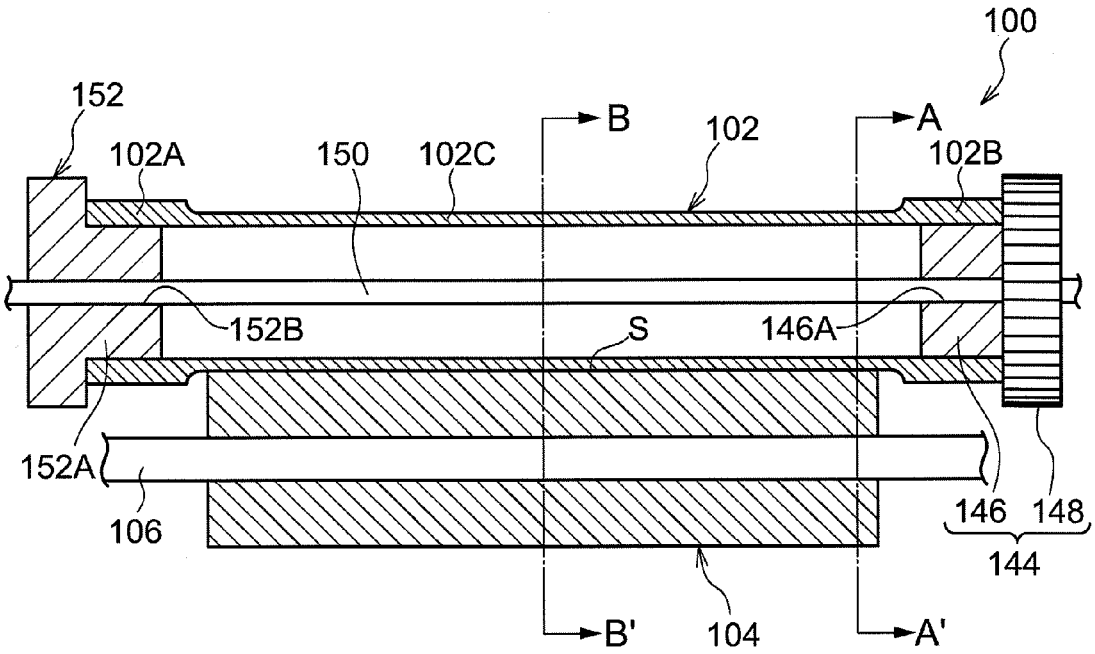
FIG. 6A is a cross-sectional view of the heating rotator and a pressure roll according to the first exemplary embodiment of the invention.

As illustrated in FIG. 6A, a driving member 144 rotated by a driving motor not illustrated is attached to a first end portion 102B of the heating rotator 102. The driving member 144 is configured of a cylindrical supporting portion 146 having an outer diameter substantially identical to an inner diameter of the heating rotator 102 and a gear unit 148 integrally formed on the end of the supporting portion 146.

A through-hole 146A into which a cylindrical bar-shaped shaft 150 extending in a longitudinal direction of the heating rotator 102 is pressed is formed on cross-sectional centers of the supporting portion 146 and the gear unit 148. The shaft 150 is pressed into the through-hole 146A and an outer peripheral surface of the supporting portion 146 is bonded to the inner peripheral surface of the heating rotator 102, and by this, the driving member 144 is attached.

On the other hand, a cap member 152 is attached to a second end 102A of the heating rotator 102. A cylindrical supporting portion 152A having an outer diameter substantially identical to the inner diameter of the heating rotator 102 is provided on the cap member 152 in a protruding manner, and a through-hole 152B into which the shaft 150 is pressed is formed on a cross-sectional center thereof.

Also, the driving member 144 is attached to the heating rotator 102, thereafter the through-hole 152B is inserted onto the shaft 150 such that the shaft 150 is pressed into the through-hole 152B and an outer peripheral surface of the supporting portion 152A is bonded to the inner peripheral surface of the heating rotator 102, and by this, the cap member 152 is attached. The both ends of the shaft 150 are inserted into bearings not illustrated provided inside the casing 120 (see FIG. 2) of the fixing device 100 to be rotatably supported.

In the heating rotator 102, both end portions 102A and 102B are thicker and with higher rigidity as compared to the center portion 102C, and further, since they are supported from the inside by the supporting portions 146 and 152A, they have shapes conforming with outer shapes of the supporting portions 146 and 152A on both ends of the pressure area S where the heating rotator 102 contacts the pressure roll 104.

Figure 6B:
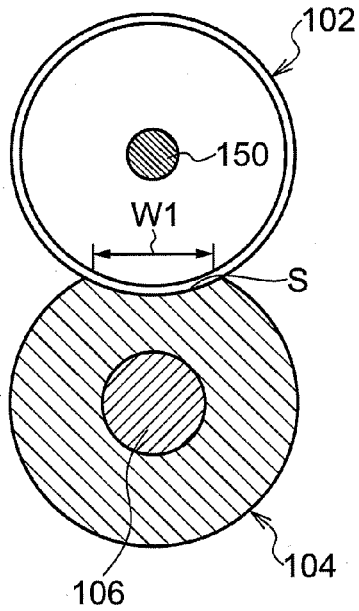
FIGS. 6B and 6C are cross-sectional views in an end portion and in a center portion in an axial direction of the heating rotator and the pressure roll according to the first exemplary embodiment of the invention.

Therefore, as illustrated in a cross section A-A' in FIG. 6B, a cross-sectional shape of the heating rotator 102 is maintained to be circular. Although the cross section A-A' indicates the cross section near a right end portion 102B of the heating rotator 102, the cross-sectional state of a left end portion 102A is similar, so that this is not illustrated. Also, in the following description of the exemplary embodiment, when the cross sections of the center and the ends of the heating rotator are illustrated, the cross sections of the ends are shown by one cross section and the other cross section is not illustrated.

The pressure roll 104 has the foamed sponge elastic layer, so that this deforms following the outer peripheral surface of the heating rotator 102 and is hollow in a radial direction. In the cross section A-A', a width of the pressure area S in a direction orthogonal to the axial direction of the heating rotator 102 is set to W1.

Figure 6C:
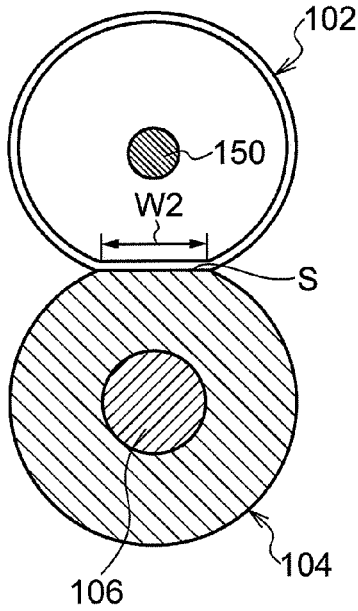

On the other hand, as illustrated in a cross section B-B' in FIG. 6C, in the center in the axial direction of the heating rotator 102, since there is no member to support from the inside, the cross-sectional shape in the heating area of the heating rotator 102 is flat. In the cross section B-B', the width of the pressure area S in the direction orthogonal to the axial direction of the heating rotator 102 is set to W2.

Action of the first exemplary embodiment of the invention will be described below.

As illustrated in FIGS. 1, 2, 5 and 6, the recording paper P to which the toner T is transferred is sent to the fixing device 100 after the image formation process of the printer 10. In the fixing device 100, the driving motor not illustrated is driven by the control unit 50, the gear unit 148 rotates and the heating rotator 102 rotates in the direction of the arrow A. The pressure roll 104 rotates in the direction of the arrow B following the same. At that time, the energizing circuit 138 is driven based on the electric signal from the control circuit 134 and the alternating current is supplied to the excitation coil 110.

When the alternating current is supplied to the excitation coil 110, the magnetic field H as the magnetic circuit is generated and disappears repeatedly around the excitation coil 110. When the magnetic field H crosses the heat generating layer 124 of the heating rotator 102, the eddy current is generated in the heat generating layer 124 such that a magnetic field to prevent the change of the magnetic field H is generated.

The heat generating layer 124 generates heat in proportion to skin resistance of the heat generating layer 124 and a size of the eddy current flowing through the heat generating layer 124, thereby heating the heating rotator 102. The temperature of the surface of the heating rotator 102 is detected by the temperature sensor 118, and when this does not reach the preset fixing temperature of 170 degrees C., the control circuit 134 drive-controls the energizing circuit 138 to apply the alternating current to the excitation coil 110. Also, when the surface reaches the preset fixing temperature, the control circuit 134 stops controlling the energizing circuit 138.

Subsequently, the recording paper P sent to the fixing device 100 is heated and pressurized by the heating rotator 102, which reaches the preset fixing temperature (170 degrees C.) and the pressure roll 104, and the toner image T is fixed on the surface of the recording paper P. The recording paper P discharged from the fixing device 100 is discharged into the accumulating unit 38 by the paper conveyance rolls 36.

Figure 7A:
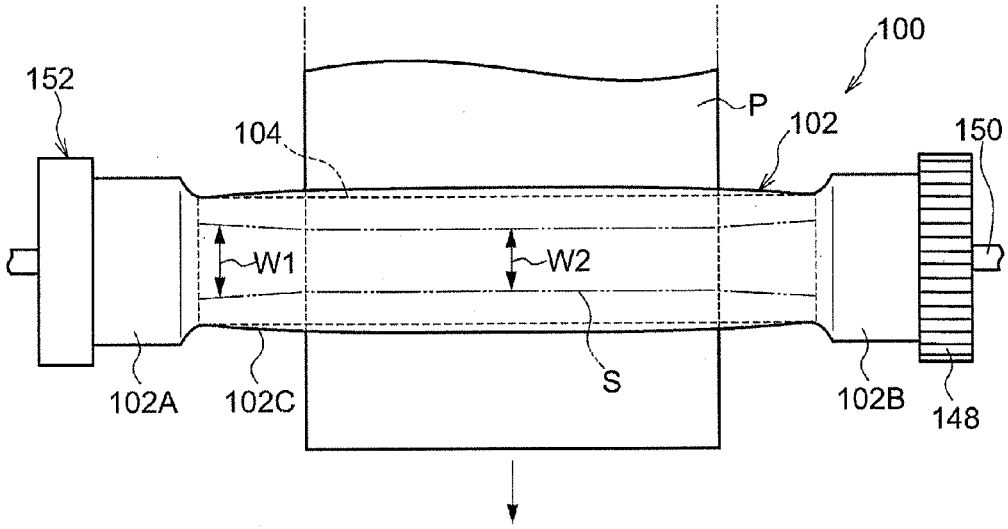
FIG. 7A is a plan view illustrating a shape of a pressure area according to the first exemplary embodiment of the invention.
Figure 7B:
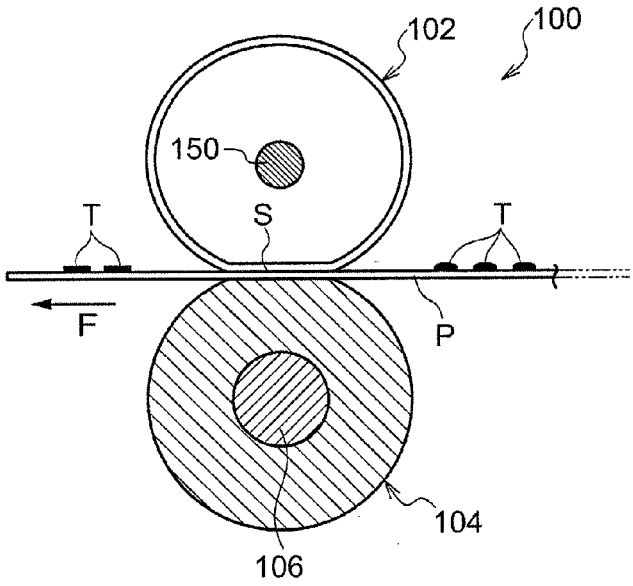
FIG. 7B is a cross-sectional view illustrating a fixing state of a toner image in the fixing device according to the first exemplary embodiment of the invention.

As illustrated in FIGS. 7A and 7B, in the fixing device 100, the recording paper P passes through the area of the width W2 of the pressure area S where the outer shapes of the heating rotator 102 and the pressure roll 104 are flat. Both end portions 102A and 102B of the heating rotator 102 are the thick-walled portions and the rigidity thereof is higher than that of the center portion 102C, so that even when driving force (rotating force) acts on the heating rotator 102 and stress of deformation of the pressure area S is transmitted to both end portions 102A and 102B, occurrence of breakage is inhibited in both end portions 102A and 102B.

Also, in the fixing device 100, since the pressure roll 104 has the foamed sponge elastic layer, thermal expansion of the pressure roll 104 is inhibited even when this is heated by the heating rotator 102; however, even when the pressure roll 104 is thermally expanded to have a larger outer diameter, since the heating rotator 102 is directly driven, a conveyance speed of the recording paper P is determined based on the outer diameter of the heating rotator 102. Therefore, the heating rotator 102 is rotate-driven while maintaining a linear velocity set in advance.

When the recording paper P is an envelope having plural layers, when the width W2 of the pressure area S where the outer shapes of the heating rotator 102 and the pressure roll 104 are flat is equal to or more than a width of the envelope, compression stress or tension stress for allowing an upper layer and a lower layer to bend in a circular arc shape hardly act on the envelope, and the toner T is fixed by action of heat and pressure while the envelope travels in a straight line in a direction of an arrow F. That is to say, due to the flat pressure area S, the recording paper having a multilayer structure such as the envelope hardly wrinkles as compared to a case in which the pressure area has a shape, which is convex upward and downward.

Another first example of the fixing device 100 of the first exemplary embodiment of the invention will be described below. The same reference numeral as in the first exemplary embodiment is given to the component basically the same as that of the first exemplary embodiment, and the description thereof will not be repeated.

Figure 8A:
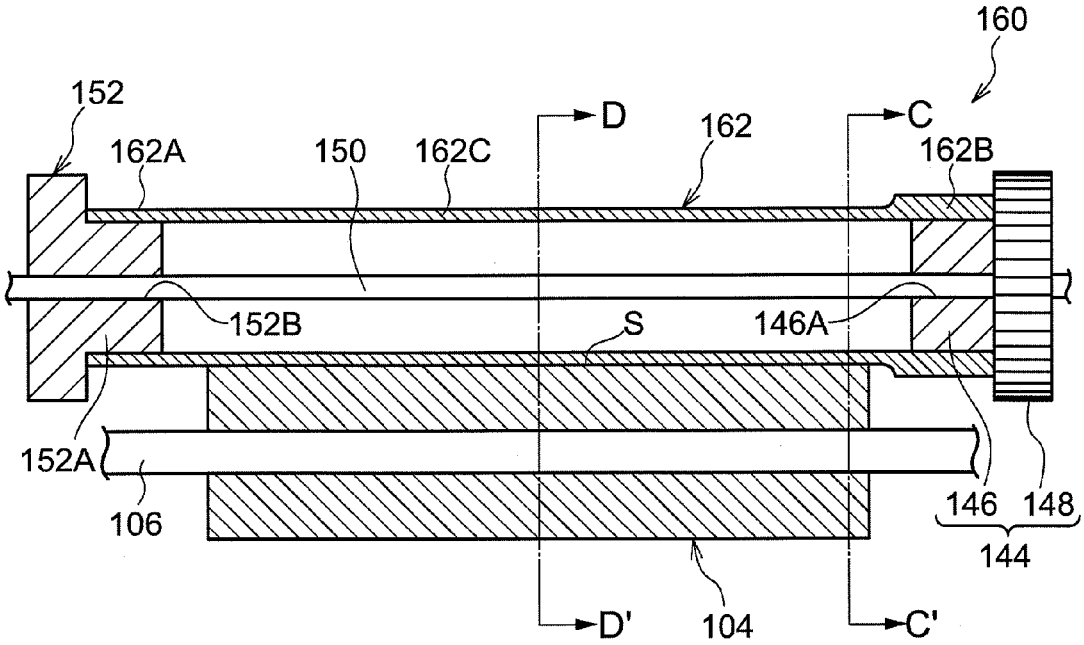
FIGS. 8A to 8C are cross-sectional views illustrating another first example of the fixing device according to the first exemplary embodiment of the invention.

FIG. 8A illustrates a fixing device 160. The fixing device 160 is provided with a heating rotator 162 in place of the heating rotator 102 of the fixing device 100 (see FIG. 2). The heating rotator 162 is a hollow cylindrical body in which an outer diameter of a first end portion 162B in an axial direction is larger than outer diameters of a second end portion 162A and the center portion 162C, and inner diameters of both end portions 162A and 162B are substantially the same as that of the center portion 102C.

Therefore, a thickness of the first end portion 162B of the heating rotator 162 is larger than a thickness of a center portion 162C, and only the first end portion 162B of the heating rotator 162 is the thick-walled portion, which is convex outward. Also, the length L in an axial direction of the heating rotator 162 is set to 300 mm. A length of the first end 162B in the axial direction of the heating rotator 162, which is determined based on the width of the recording paper P on which the fixation is performed (see FIG. 1), is set to 30 mm.

A layer configuration of the heating rotator 162 is similar to that of the heating rotator 102 in which the base layer 122, the heat generating layer 124, the protecting layer 126, the elastic layer 128 and the release layer 130 (see FIG. 3B) are stacked from the inner side to the outer side in the radial direction to be integral with one another. Also, the driving member 144 is attached to the first end portion 162B of the heating rotator 162, and the cap member 152 is attached to the second end portion 162A of the heating rotator 162.

In the heating rotator 162, the first end portion 162B is thicker and with higher rigidity as compared to the center portion 162C, and further, both end portions 162A and 162B are supported from the inside by the supporting portions 146 and 152A, so that they have shapes conforming with the outer shapes of the supporting portions 146 and 152A on both ends of the pressure area S where the heating rotator 162 contacts the pressure roll 104.

Figure 8B:
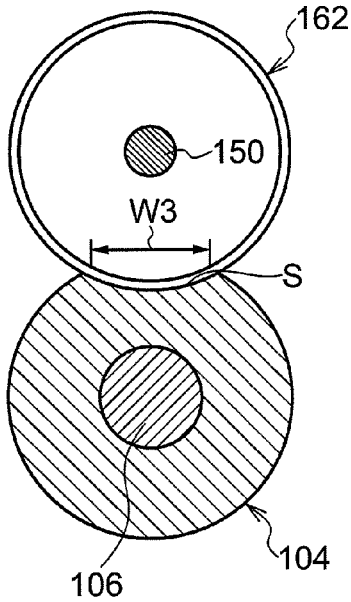

Therefore, as illustrated in a cross section C-C' in FIG. 8B, a cross-sectional shape of the heating rotator 162 is maintained to be circular. Also, since the pressure roll 104 has the foamed sponge elastic layer, this deforms following the outer peripheral surface of the heating rotator 162 and is hollow in the radial direction. In the cross section C-C', the width of the pressure area S in the direction orthogonal to the axial direction of the heating rotator 162 is set to W3.

Figure 8C:
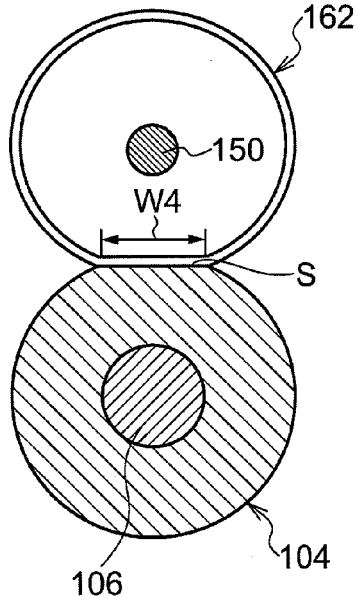

On the other hand, as illustrated in a cross section D-D' in FIG. 8C, in the center 162C in the axial direction of the heating rotator 162, since there is no member to support from the inside, the cross-sectional shape in the pressure area S of the heating rotator 162 is flat. In the cross section D-D', the width of the pressure area S in the direction orthogonal to the axial direction of the heating rotator 162 is set to W4.

As illustrated in FIG. 8A, in the fixing device 160, the recording paper P passes through the area of the width W4 of the pressure area S where the outer shapes of the heating rotator 162 and the pressure roll 104 are flat. The first end portion 162B of the heating rotator 162 is the thick-walled portion and the rigidity thereof is higher than that of the center portion 162C, and further, the second end portion 162A of the heating rotator 162 is supported by the supporting portion 152A, so that occurrence of the breakage is inhibited in both end portions 162A and 162B.

Another second example of the fixing device 100 of the first exemplary embodiment of the invention will be described below. The same reference numeral as in the first exemplary embodiment is given to the component basically the same as that of the first exemplary embodiment and the description thereof will not be repeated.

Figure 9A:
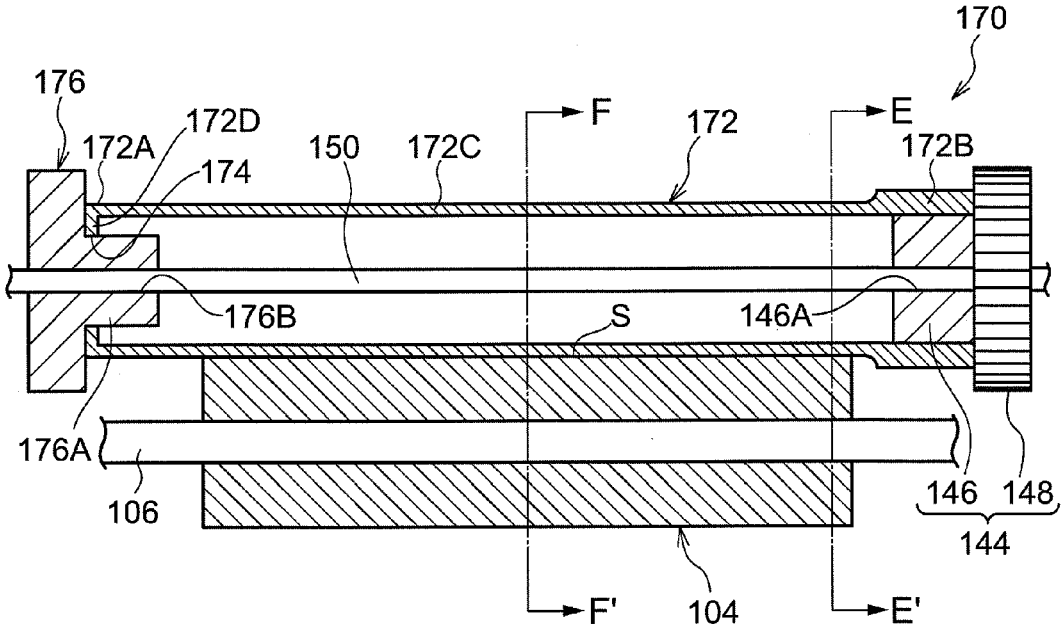
FIGS. 9A to 9C are cross-sectional views illustrating another second example of the fixing device according to the first exemplary embodiment of the invention.

FIG. 9A illustrates a fixing device 170. The fixing device 170 is provided with a heating rotator 172 in place of the heating rotator 102 of the fixing device 100 (see FIG. 2). The heating rotator 172 is a hollow cylindrical body in which an outer diameter of a first end portion 172B in an axial direction is larger than outer diameters of a second end portion 172A and a center portion 172C, and an inner diameter of the first end portion 172B is substantially the same as that of the center portion 172C.

Also, an end face 172D bent to an inner side in the radial direction toward the shaft 150 so as to be L-shape in cross section is formed on the second end portion 172A of the heating rotator 172. The end face 172D is circular as seen in the axial direction of the shaft 150, and a through-hole 174 is formed on a center of the circle. A cap member 176 is attached to the through-hole 174 of the end face 172D. The end face 172D extends in the radial direction of the heating rotator 172 to be the thick-walled portion.

On the cap member 176, a cylindrical supporting portion 176A having an outer diameter substantially identical to an inner diameter of the through-hole 174 is provided in a protruding manner, and a through-hole 176B into which the shaft 150 is pressed is formed on a cross-sectional center thereof. The driving member 144 is attached to the heating rotator 172, thereafter the through-hole 176B is inserted onto the shaft 150 such that the shaft 150 is pressed into the through-hole 176B and an outer peripheral surface of the supporting portion 176A is bonded to an inner peripheral surface of the through-hole 176B, and by this, the cap member 176 is attached.

In the heating rotator 172, the first end portion 172B and the second end portion 172A in the L-shape in cross section are thicker and with higher rigidity as compared to the center portion 172C, and further, they are supported from the inside by the supporting portions 146 and 176A, so that they have shapes conforming with the outer shapes of the supporting portions 146 and 176A on both ends of the pressure area S where the heating rotator 172 contacts the pressure roll 104.

A thickness of the first end portion 172B of the heating rotator 172 is larger than a thickness of the center portion 172C, and only the first end portion 172B of the heating rotator 172 is the thick-walled portion, which is convex outward. Also, the length L in an axial direction of the heating rotator 172 is set to 300 mm. The length of the first end portion 172B in the axial direction of the heating rotator 172, which is determined based on the width of the recording paper P on which the fixation is performed (see FIG. 1), is set to 30 mm.

A layer configuration of the heating rotator 172 is similar to that of the heating rotator 102 in which the base layer 122, the heat generating layer 124, the protecting layer 126, the elastic layer 128 and the release layer 130 (see FIG. 3B) are stacked from the inner side to the outer side in the radial direction to be integral with one another.

A method of fabricating the heating rotator 172 will be described below.

Figure 10A:
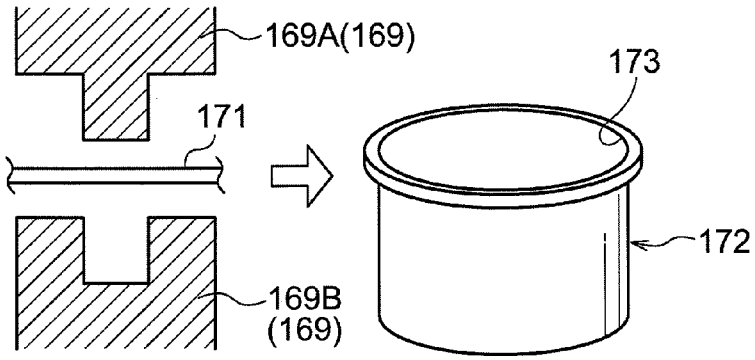
FIGS. 10A to 10C are process charts illustrating a method of manufacturing the heating rotator of another second example of the fixing device according to the first exemplary embodiment of the invention.

As illustrated in FIG. 10A, a plate member 171 made of the clad steel in which the base layer 122, the heat generating layer 124 and the protecting layer 126 (see FIG. 3) are integral with one another is first formed. Then, the plate member 171 is pressed by a pressing machine 169 having a convex mold 169A and a concave mold 169B to form the heating rotator 172 having a cup shape with a bottom with a hollow portion 173 inside thereof.

Figure 10B:
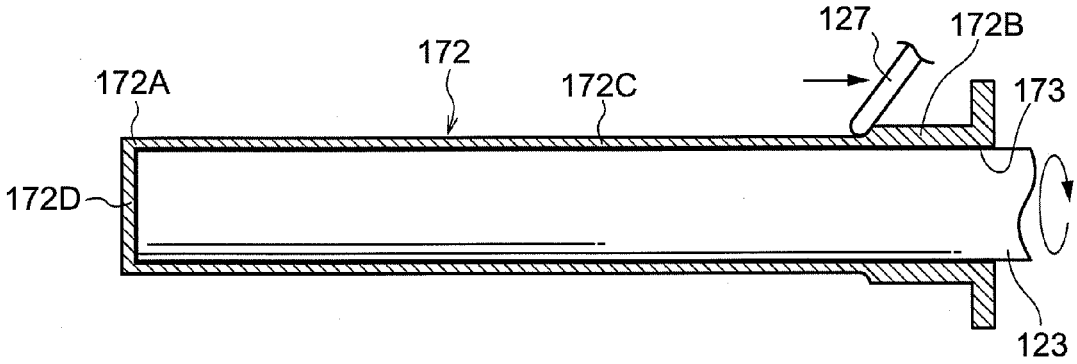

Subsequently, as illustrated in FIG. 10B, the heating rotator 172 is attached to a rotating shaft 123 by inserting the hollow portion 173 thereof onto the rotating shaft 123, the rotating shaft 123 is rotated, and a spatula 127 is moved in a direction of an arrow along the rotating shaft 123 to apply spinning. Then, by removing the spatula 127 halfway, a thick-walled end is formed on the first end portion of 172B of the heating rotator 172 and the center 172C is formed on the center thereof. At that time, the second end 172A side of the heating rotator 172 is closed and the end face (circular plate portion) 172D is formed.

Figure 10C:
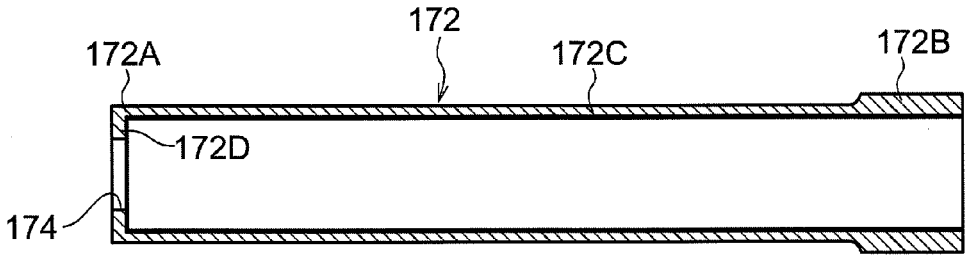

Subsequently, as illustrated in FIG. 10C, after the rotation of the rotating shaft 123 is stopped, the heating rotator 172 is removed from the rotating shaft 123 and the through-hole 174 is formed on the center of the circular plate portion 172D by means of a drill (not illustrated). In this manner, the heating rotator 172 having the thick-walled end formed on the first end portion 172B and the through-hole 174 is formed.

As illustrated in FIG. 9A, in the heating rotator 172, the first end 172B is thicker and with higher rigidity as compared to the center portion 172C, and further, both end portions 172A and 172B are supported from the inside by the supporting portions 176A and 146, so that they have shapes conforming with the outer shapes of the supporting portions 176A and 146 on both ends of the pressure area S where the heating rotator 172 contacts the pressure roll 104.

Figure 9B:
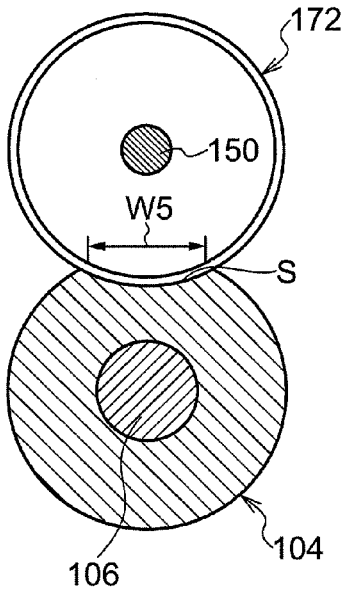

Therefore, as illustrated in a cross section E-E' in FIG. 9B, the cross-sectional shape of the heating rotator 172 is maintained to be circular. Also, since the pressure roll 104 has the foamed sponge elastic layer, this deforms following the outer peripheral surface of the heating rotator 172 and is hollow in the radial direction. In the cross section E-E', the width of the pressure area S in the direction orthogonal to the axial direction of the heating rotator 172 is set to W5.

Figure 9C:
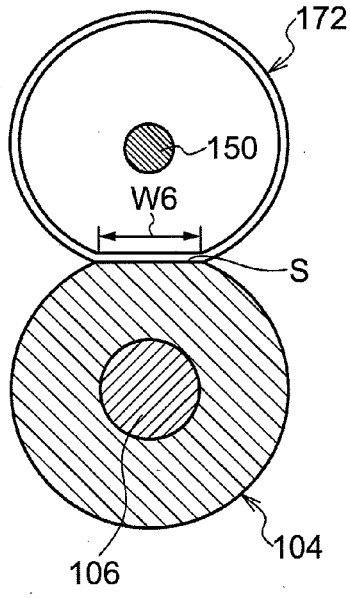

On the other hand, as illustrated in a cross section F-F' in FIG. 9C, in the center portion 172C in the axial direction of the heating rotator 172, since there is no member to support from the inside, the cross-sectional shape in the pressure area S of the heating rotator 172 is flat. In the cross-section F-F', the width of the pressure area S in the direction orthogonal to the axial direction of the heating rotator 172 is set to W6.

As illustrated in FIG. 9A, in the fixing device 170, the recording paper P passes through the area of the width W6 of the pressure area S where the outer shapes of the heating rotator 172 and the pressure roll 104 are flat. The first end portion 172B of the heating rotator 172 is the thick-walled portion and the rigidity thereof is higher than that of the center portion 172C, and further, the second end portion 172A of the heating rotator 172 is supported by the supporting portion 176A, so that the occurrence of the brakeage is inhibited in both ends 172A and 172B.

A heating rotator, a fixing device and an image forming device in accordance with the second exemplary embodiment of the invention will be described below with reference to the drawings. The same reference numeral as in the first exemplary embodiment is given to the component basically the same as that of the first exemplary embodiment and the description thereof will not be repeated.

Figure 11:
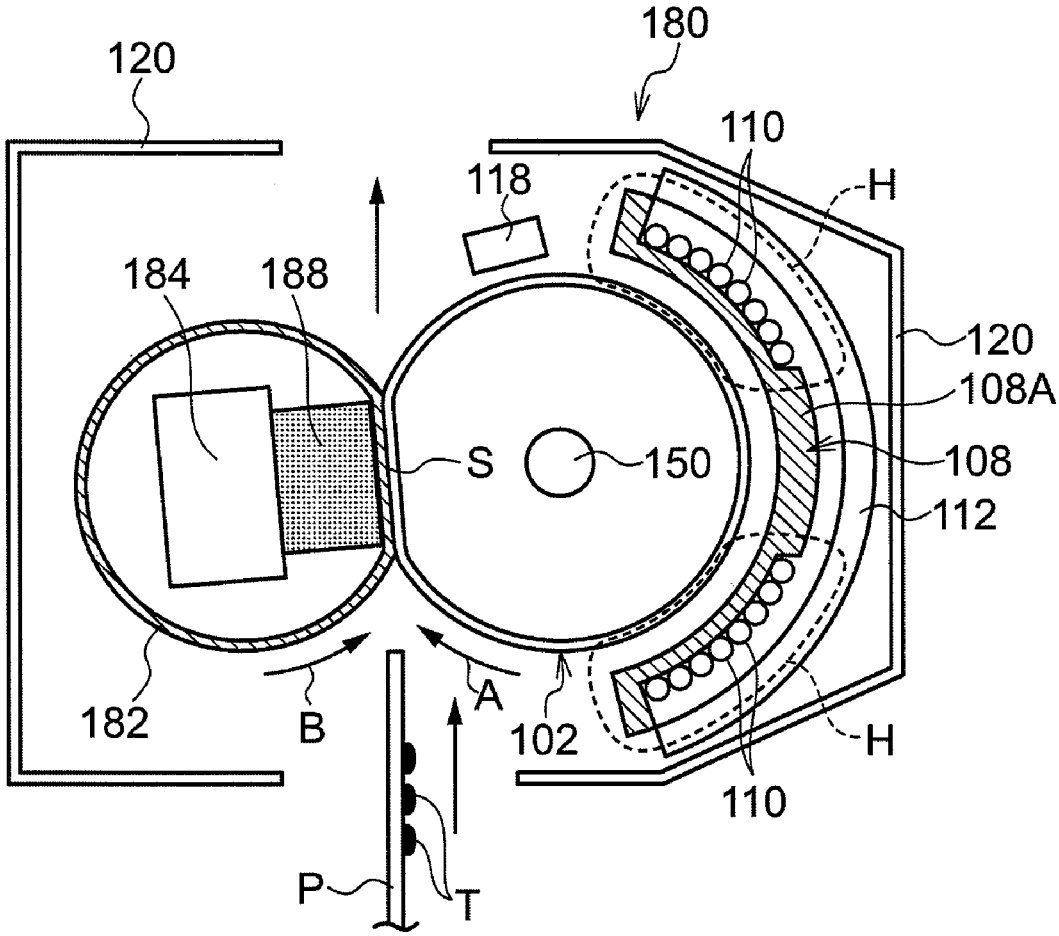
FIG. 11 is a cross-sectional view of the fixing device according to a second exemplary embodiment of the invention.

FIG. 11 illustrates a fixing device 180. In the fixing device 180, an endless pressure belt 182 is used in place of the pressure roll 104 of the fixing device 100 of the first exemplary embodiment.

The pressure belt 182 is configured such that a base layer in an endless belt shape made of polyimide having a thickness of 60 μm is covered with a release layer made of PFA having a thickness of 30 μm. Also, a width of the pressure belt 182 is set to 240 mm. Since a flexible pressure belt 182 is preferred, this may be made of steel, stainless steel and electroformed nickel having a thickness of 20 to 40 μm, for example.

Figure 12A:
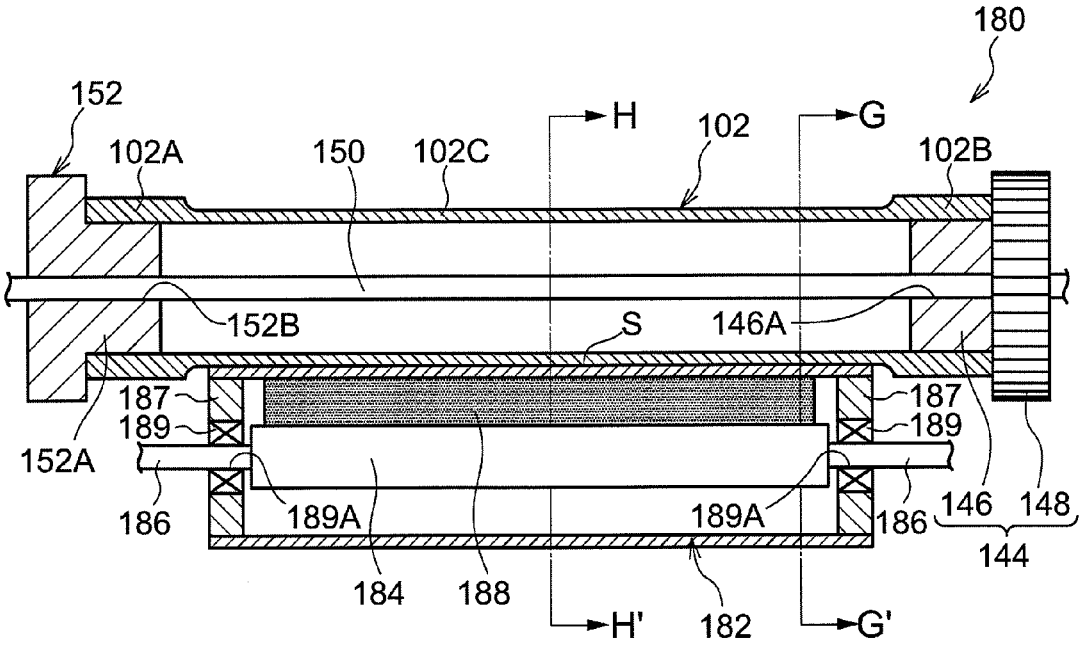
FIG. 12A is a cross-sectional view of the heating rotator and the pressure roll according to the second exemplary embodiment of the invention.

On the other hand, as illustrated in FIG. 12A, a rectangular cylindrical supporting member 184 is provided on a substantially center portion of inside the pressure belt 182. In the supporting member 184, cylindrical spindles 186 are provided on both end faces in an axial direction in an outwardly protruding manner, and ends of the spindles 186 are fixed to side surface portions of the casing 120 (see FIG. 11) of the fixing device 180.

One side surface of a rectangular parallelepiped pressure pad 188 made of polyphenylene sulfide (PPS) being a heat resistance resin is bonded to one side surface (a side on which the heating rotator 102 contacts the pressure belt 182) of the supporting member 184. Also, the other side surface of the pressure pad 188 contacts an inner peripheral surface of the pressure belt 182 to pressurize the pressure area S where the heating rotator 102 contacts the pressure belt 182. A load acting on the pressure area S is set to 20 kgf. The pressure pad 188 may be configured of a liquid crystal polymer.

On the other hand, disk-like cap members 187 having an outer diameter substantially identical to an inner diameter of the pressure belt 182 are attached to inner sides of both ends of the pressure belt 182. Through-holes are formed on centers of the cap members 187 and bearings 189 are fit to be fixed to the through-holes.

The supporting member 184 and the pressure pad 188 are arranged inside the pressure belt 182, and thereafter hole portions 189A of the bearings 189 are inserted onto the spindles 186 to bond an outer peripheral surface to an inner side of the pressure belt 182, and by this, the cap members 187 are attached to both ends of the pressure belt 182. Therefore, the pressure belt 182 is rotatably supported around the spindles 186 and is driven to rotate by the rotation of the heating rotator 102.

A cross-sectional state of the heating rotator 102 and the heating belt 182 will be described below.

As illustrated in FIG. 12A, the gear unit 148 is attached to a first end of the heating rotator 102, and the cap member 152 is attached to a second end. In the heating rotator 102, the first end 102B is thicker and with higher rigidity as compared to the center portion 102C, and further, since both end portions 102A and 102B are supported from the inside by the supporting portions 152A and 146, they have shapes conforming with the outer shapes of the supporting portions 152A and 146 on both ends of the pressure area S where the heating rotator 102 contacts the pressure belt 182.

Figure 12B:
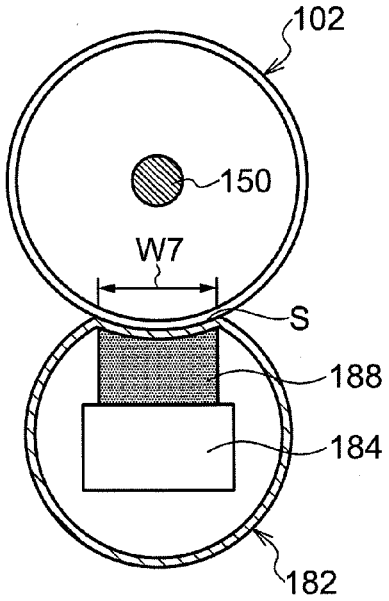
FIGS. 12B and 12C are cross-sectional views in the end portion and in the center portion of the heating rotator and the pressure roll according to the second exemplary embodiment of the invention.

Therefore, as illustrated in a cross section G-G' in FIG. 12B, the cross-sectional shape of the heating rotator 102 is maintained to be circular. Also, since the pressure belt 182 is a thin-walled cylindrical body, this deforms following the outer peripheral surface of the heating rotator 102 and is hollow in the radial direction. In the cross section G-G', the width of the pressure area S in the direction orthogonal to the axial direction of the heating rotator 102 is set to W7.

Figure 12C:
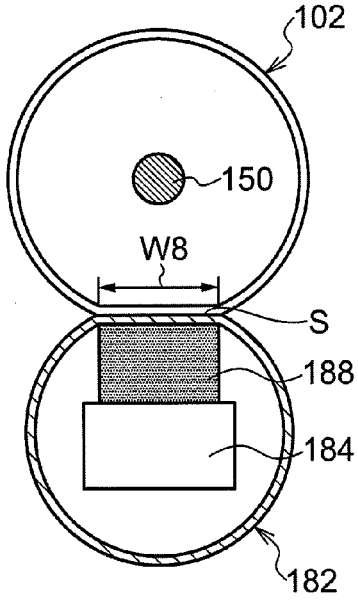

On the other hand, as illustrated in a cross section H-H' in FIG. 12C, in the center portion 102C in the axial direction of the heating rotator 102, since there is no member to support from the inside, the cross-sectional shape in the pressure area S of the heating rotator 102 is flat. In the cross section H-H', the width of the pressure area S in the direction orthogonal to the axial direction of the heating rotator 102 is set to W8.

Since the heating rotator 102 and the supporting member 184 bend by receiving the load, the widths W7 and W8 of the pressure area S are such that the width W8 in the center portion 102C is narrower than the width W7 in both end portions 102A and 102B in the axial direction of the heating rotator 102. By changing a material or a shape of the pressure pad 188, the width of the pressure area S in the axial direction of the heating rotator 102 is adjusted. For example, a height in the axial direction of the pressure pad 188 is made larger in the center than in the ends, or a thickness on the pressure pad 188 side of the supporting member 184 may be made such that the center is convex.

Action of the second exemplary embodiment of the invention will be described below.

As illustrated in FIG. 11, the recording paper P to which the toner T is transferred is sent to the fixing device 180. In the fixing device 180, the heating rotator 102 rotates in the direction of the arrow A, and the pressure belt 182 follows the same to rotate in the direction of the arrow B. Then, the alternating current is supplied to the excitation coil 110, the magnetic field H is generated and disappears repeatedly around the excitation coil 110, and the heat generating layer 124 of the heating rotator 102 generates heat, thereby heating the heating rotator 102.

Subsequently, the recording paper P sent to the fixing device 180 is heated and pressurized by the heating rotator 102, which reaches the preset fixing temperature determined in advance, and the pressure belt 182, and the toner image T is fixed on the surface of the recording paper P.

Figure 13:
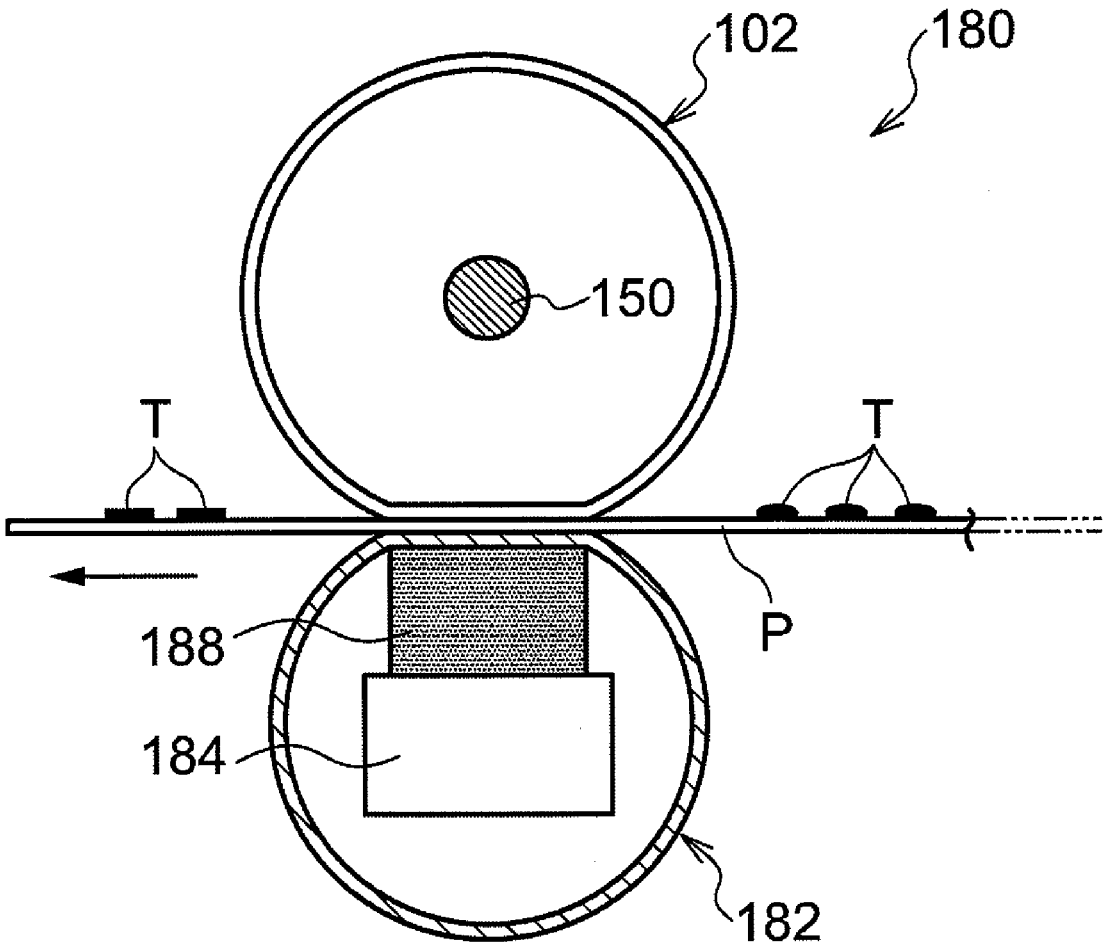
FIG. 13 is a cross-sectional view illustrating the fixing state of the toner image in the fixing device according to the second exemplary embodiment of the invention.

As illustrated in FIGS. 12A and 13, in the fixing device 180, the recording paper P passes through the area of the width W8 of the pressure area S where the outer shapes of the heating rotator 102 and the pressure belt 182 are flat. Since both end portions 102A and 102B of the heating rotator 102 are the thick-walled portions and the rigidity thereof is higher than that of the center portion 102C, even when the driving force (rotating force) acts on the heating rotator 102 and the stress of the deformation of the pressure area S is transmitted to both end portions 102A and 102B, the occurrence of the breakage in both end portions 102A and 102B is inhibited.

Also, in the fixing device 180, by changing the material or the shape of the pressure pad 188 arranged inside the pressure belt 182, the width of the pressure area S in the axial direction of the heating rotator 102 is adjusted. Therefore, a predetermined amount of heat and pressure force are applied to the toner T on the recording paper P and the fixation is performed.

A heating rotator, a fixing device and an image forming device in accordance with the third exemplary embodiment of the invention will be described below with reference to the drawings. The same reference numeral as in the first and second exemplary embodiments is given to the component basically the same as that of the first and second exemplary embodiments and the description thereof will not be repeated.

Figure 14A:
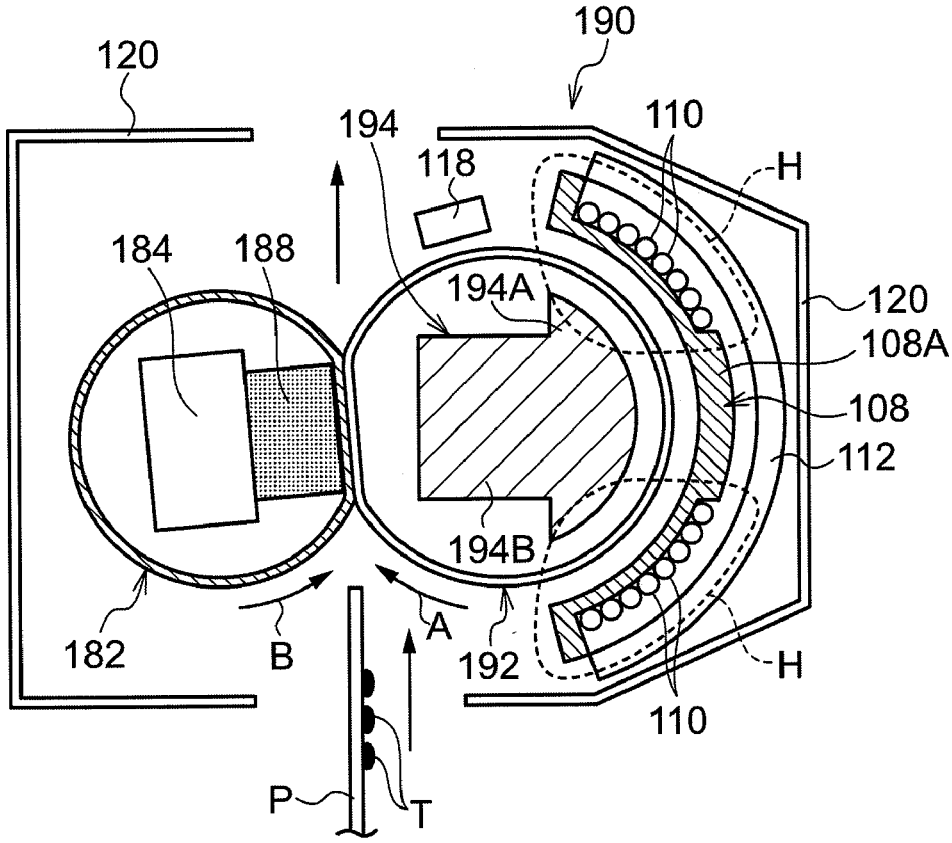
FIG. 14A is a cross-sectional view of the fixing device according to a third exemplary embodiment of the invention.

FIG. 14A illustrates a fixing device 190. The fixing device 190 is provided with a heating rotator 192 and an inner member 194 arranged inside the heating rotator 192 in place of the heating rotator 102 in the fixing device 180 in the second exemplary embodiment. A length in an axial direction of the pressure belt 182 is set to 360 mm, and a length in an axial direction of the pressure pad 188 is set to 350 mm.

Figure 14B:
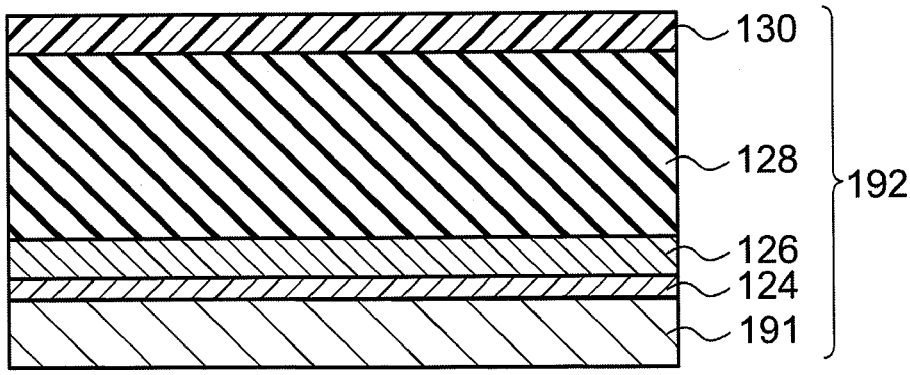
FIG. 14B is a cross-sectional view illustrating a layer configuration of the heating rotator according to the third exemplary embodiment of the invention.

As illustrated in FIG. 14B, the heating rotator 192 is configured of a base layer 191, the heat generating layer 124, the protecting layer 126, the elastic layer 128 and the release layer 130 from the inner side to the outer side in the radial direction, and they are stacked to be integral with one another. The length in an axial direction of the heating rotator 192 is set to 370 mm.

Figure 17:
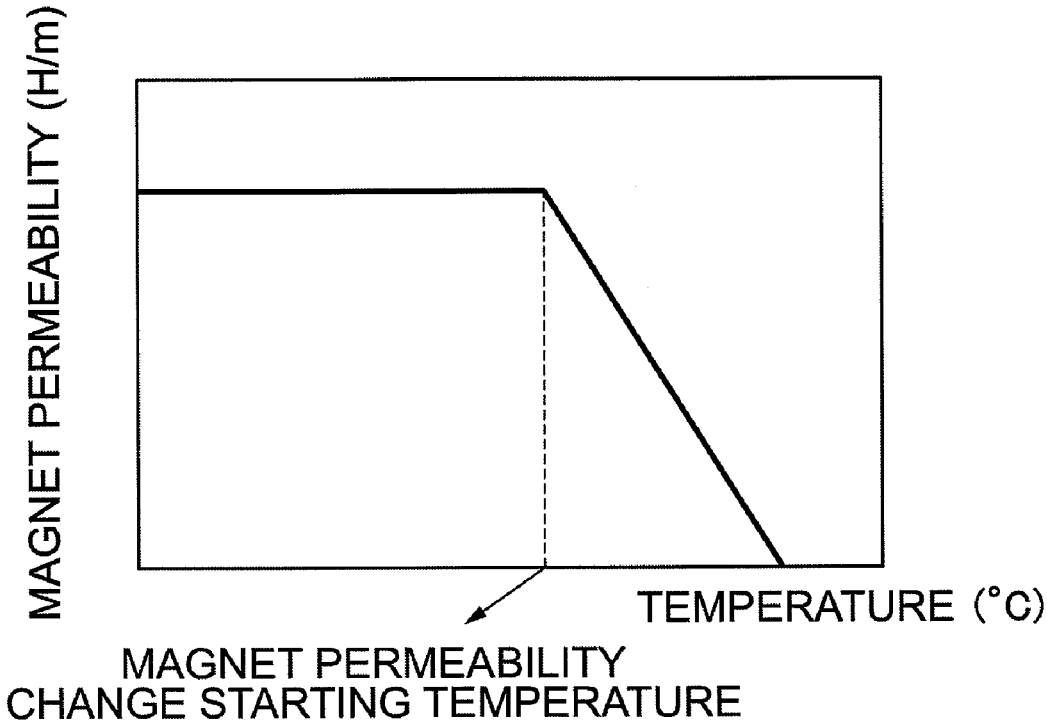
FIG. 17 is a schematic diagram illustrating a relationship between magnetic permeability and a temperature of a base layer of the heating rotator according to the third exemplary embodiment of the invention.

The base layer 191 is configured of temperature-sensitive magnetic metal having a characteristic that magnetic permeability starts continuously lowering from a magnetic permeability change starting temperature within a temperature range equal to or higher than a preset heating temperature of the heating rotator 192 and equal to or lower than a heatproof temperature of the heating rotator 192. Specifically, magnetic compensator alloys flux, an amorphous alloy and the like are used, and it is preferable to use a metal alloy material configured of Fe, Ni, Si, B, Nb, Cu, Zr, Co, Cr, V, Mn, Mo and the like, for example, a binary temperature-sensitive magnetic alloy of Fe—Ni and a trinery temperature-sensitive magnetic alloy of Fe—Ni—Cr. As illustrated in FIG. 17, the magnetic permeability change starting temperature is the temperature at which the magnetic permeability (measured in accordance with JIS C2531) starts continuously lowering, and a point on which a penetration amount of the magnetic flux of the magnetic field H starts changing.

As illustrated in FIGS. 14A and 14B, in this exemplary embodiment, the heatproof temperature and the preset fixing temperature of the fixing device 190 are set to 240 degrees C. and 170 degrees C., respectively, and steel of which magnetic permeability change starting temperature is approximately 200 degrees C. and having a thickness of 90 μm is used as the base layer 191. Therefore, the base layer 191 becomes a ferromagnetic material at a temperature lower than the magnetic permeability change starting temperature to allow the magnetic field H generated by the excitation coil 110 to penetrate. Also, the base layer 191 becomes nonmagnetic (paramagnetic material) at a temperature higher than the magnetic permeability change starting temperature and the penetration amount of the magnetic flux of the magnetic field H becomes large. In FIG. 14A, a magnetic path of the magnetic field H in a state in which the base layer 191 of the heating rotator 192 is equal to or higher than the magnetic permeability change starting temperature is illustrated.

On the other hand, the inner member 194 made of aluminum being a nonmagnetic body is arranged inside the heating rotator 192 so as not to contact the heating rotator 192. Cylindrical spindles 195 (see FIG. 15A) are provided on both ends of the inner member 194 in an outward protruding manner, and the spindles 195 are fixed to the casing 120 of the fixing device 190.

The inner member 194 is configured of a circular arc portion 194A formed in a circular arc shape so as to be opposed to the heating rotator 192 and a column portion 194B formed in a column shape, and the circular arc portion 194A and the column portion 194B are integrally formed. The circular arc portion 194A is out of contact with the heating rotator 192. When the magnetic flux of the magnetic field H penetrates the heating rotator 192, a closed magnetic path by the magnetic field H is formed between the circular arc portion 194A and the magnetic body core 112. The pressure belt 182 contacts an outer peripheral surface of the heating rotator 192.

A cross-sectional state of the heating rotator 192 and the pressure belt 182 will be described below.

Figure 15A:
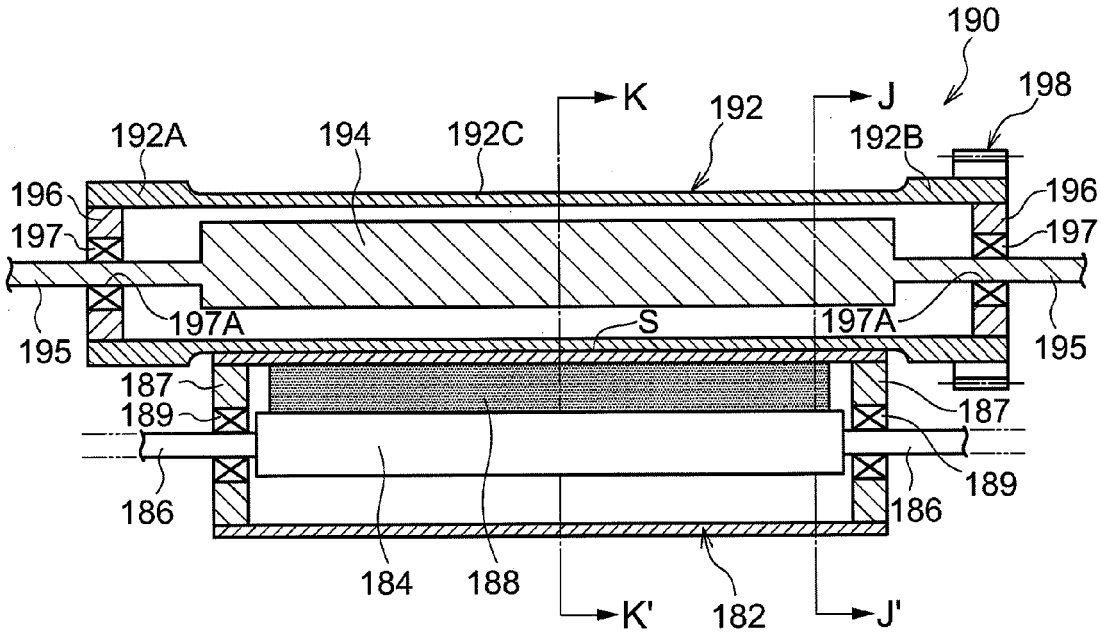
FIG. 15A is a cross-sectional view of the heating rotator and the pressure roll according to the third exemplary embodiment of the invention.

As illustrated in FIG. 15A, disk-like cap members 196 having an outer diameter substantially identical to an inner diameter of the heating rotator 192 are attached to inner sides of both ends of the heating rotator 192. Through-holes are formed on centers of the cap members 196 and bearings 197 are fit to be fixed to the through-holes.

The inner member 194 is arranged inside the heating rotator 192, and thereafter hole portions 197A of the bearings 197 are inserted onto the spindles 195 to bond an outer peripheral surface to an inner side of the heating rotator 192, and by this, the cap members 196 are attached to both ends of the heating rotator 192. Therefore, the heating rotator 192 is rotatably supported around the spindles 195.

Also, the heating rotator 192 is formed by the method of fabricating similar to that of the heating rotator 102, and both end portions 192A and 192B are thicker and with higher rigidity as compared to the center portion 192C. A gear 198 for driving is bonded to be fixed to an outer peripheral surface of the first end portion 192B of the heating rotator 192.

Further, in the heating rotator 192, since both end portions 192A and 192B are supported from the inside by the cap members 196, they have shapes conforming with outer shapes of the cap members 196 on both ends of the pressure area S where the heating rotator 192 contacts the pressure belt 182.

Figure 15B:
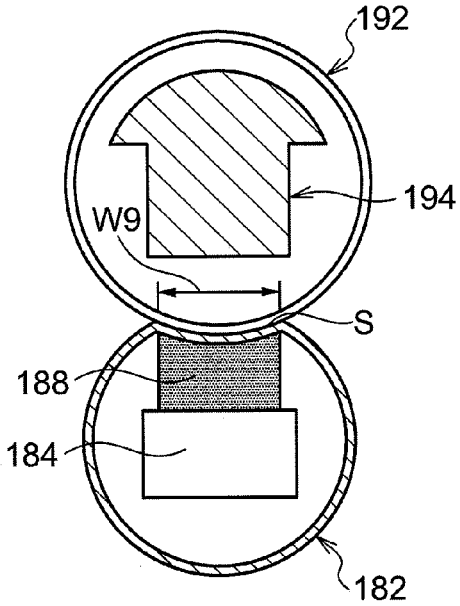
FIGS. 15B and 15C are cross-sectional views in the end portion and in the center portion in the axial direction of the heating rotator and the pressure roll according to the third exemplary embodiment of the invention.

Therefore, as illustrated in a cross section J-J' in FIG. 15B, on both end positions of the pressure area S, a cross-sectional shape of the heating rotator 192 is maintained to be circular. Also, since the pressure belt 182 is a thin-walled cylindrical body, this deforms following the outer peripheral surface of the heating rotator 192 and is hollow in the radial direction. In the cross section J-J', the width of the pressure area S in the direction orthogonal to the axial direction of the heating rotator 192 is set to W9.

Figure 15C:
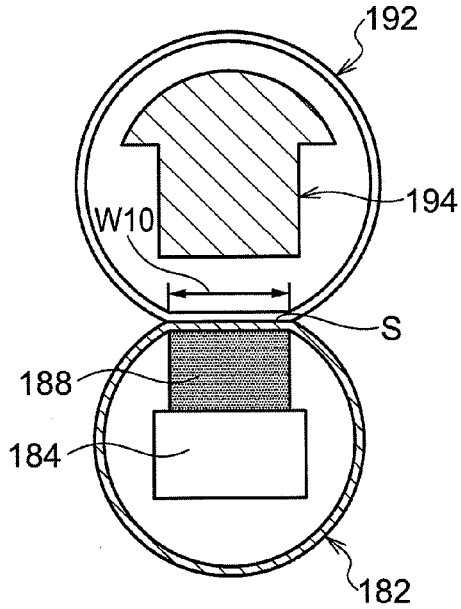

On the other hand, as illustrated in a cross section K-K' in FIG. 15C, in the center portion 192C in the axial direction of the heating rotator 192, since there is no member to support from the inside, the cross-sectional shape in the pressure area S of the heating rotator 192 is flat. In the cross section K-K', the width of the pressure area S in the direction orthogonal to the axial direction of the heating rotator 192 is set to W10.

As illustrated in FIGS. 15A, 15B and 15C, since the heating rotator 192 and the supporting member 184 bend by receiving the load, the widths W9 and W10 of the pressure area S are such that the width W10 in the center portion 192C is narrower than the width W9 in both end portions 192A and 192B in the axial direction of the heating rotator 192. By changing the material or the shape of the pressure pad 188, the width of the pressure area S in the axial direction of the heating rotator 192 is adjusted. For example, the height in the axial direction of the pressure pad 188 may be made larger in the center than in the ends, or the thickness on the pressure pad 188 side of the supporting member 184 may be made such that the center is convex.

Action of the third exemplary embodiment of the invention will be described below.

Figure 16A:
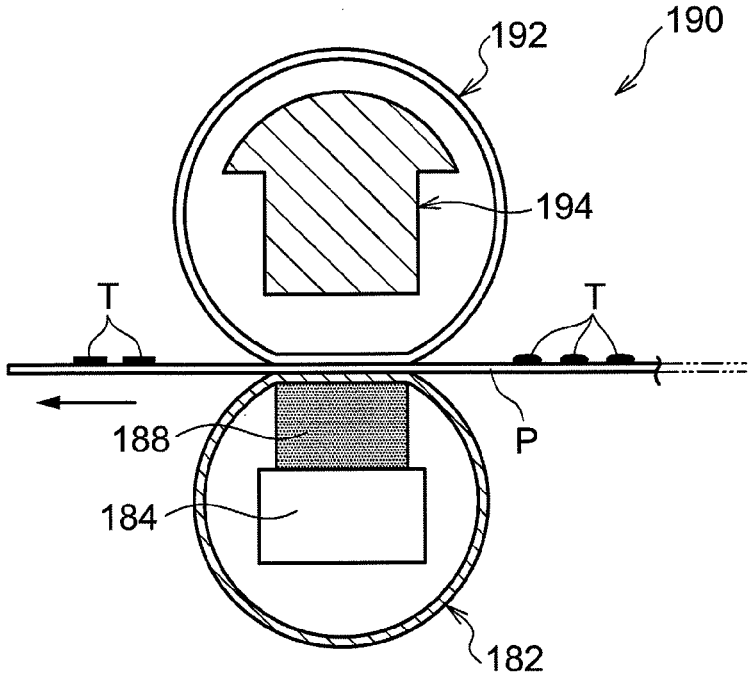
FIG. 16A is a cross-sectional view illustrating the fixing state of the toner image in the fixing device according to the third exemplary embodiment of the invention.

As illustrated in FIGS. 14A and 16A, the recording paper P to which the toner T is transferred is sent to the fixing device 190. In the fixing device 190, the heating rotator 192 rotates in the direction of the arrow A, and the pressure belt 182 follows the same to rotate in the direction of the arrow B. Then, the alternating current is supplied to the excitation coil 110, the magnetic field H is generated and disappears repeatedly around the excitation coil 110 and the heat generating layer 124 (see FIG. 14B) of the heating rotator 192 generates heat, thereby heating the heating rotator 192.

Subsequently, the recording paper P sent to the fixing device 190 is heated and pressurized by the heating rotator 192, which reaches the preset fixing temperature determined in advance, and the pressure belt 182, and the toner T is fixed on the surface of the recording paper P.

In the fixing device 190, the recording paper P passes through the area of the width W9 of the pressure area S where the outer shapes of the heating rotator 192 and the pressure belt 182 are flat. As illustrated in FIG. 15A, both end portions 192A and 192B of the heating rotator 192 are the thick-walled portions and the rigidity thereof is higher than that of the center portion 192C, so that even when the driving force (rotating force) acts on the heating rotator 192 and the stress of the deformation of the pressure area S is transmitted to both end portions 192A and 192B, the occurrence of the breakage in both end portion s 192A and 192B is inhibited.

Also, in the fixing device 190, by changing the material or the shape of the pressure pad 188 arranged inside the pressure belt 182, the width of the pressure area S in the axial direction of the heating rotator 192 is adjusted. Therefore, the amount of heat and the pressure force determined in advance are applied to the toner T on the recording paper P and the fixation is performed.

In the fixing device 190, when the temperature of the base layer 191 (see FIG. 14B) of the heating rotator 192 is equal to or lower than the magnetic permeability change starting temperature, since the base layer 191 is the ferromagnetic body, the magnetic field H penetrating the heat generating layer 124 penetrates the base layer 191 to form the closed magnetic path, thereby strengthening the magnetic field H. Therefore, the amount of heat generation of the heat generating layer 124 reaches a required amount of heat generation.

Figure 16B:
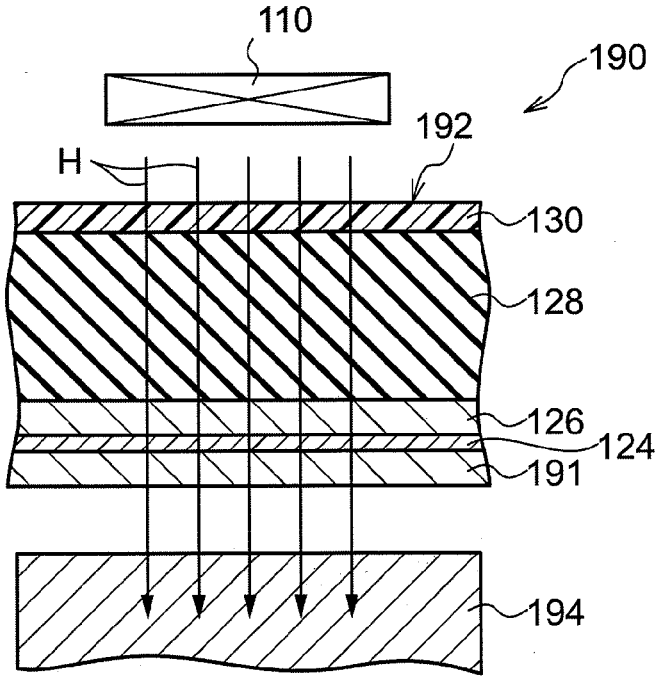
FIG. 16B is a cross-sectional view illustrating a state in which a magnetic field penetrates the heating rotator according to the third exemplary embodiment of the invention.

On the other hand, as illustrated in FIGS. 14A and 16B, in the fixing device 190, when the temperature of the base layer 191 of the heating rotator 192 becomes equal to or higher than the magnetic permeability change starting temperature, the magnetic field H penetrates the base layer 191 and reaches the inner member 194 to form the closed magnetic path. At that time, the magnetic field H acting on the heat generating layer 124 is weakened as compared to a case in which the closed magnetic path is formed in the base layer 191, so that the amount of heat generation of the heat generating layer 124 is reduced and the temperature of the heat generating layer 124 is not increased unnecessarily.

The invention is not limited to the exemplary embodiments.

The printer 10 may be not only a xerographic type using a solid developer (toner) but also the one using a liquid developer.

Each thick-walled portion of the heating rotators 102, 162, 172 and 192 may be convex outward or convex inward in the radial direction of the heating rotator. Also, in the fixing devices 180 and 190, the heating rotators 102 and 192 having the thick-walled portions on both ends thereof may be replaced with the heating rotator 162 having the thick-walled portion on a first end.

As a heating device for heating the heating rotators 102 and 192, a heater may be arranged inside or outside the heating rotators 102 and 192 other than the excitation coil 110. Further, the installation position of the temperature sensor 118 of the heating rotators 102 and 192 is not limited on the surface side of the heating rotators 102 and 192, and the temperature sensor 118 may be attached inside (inner peripheral surface of) the heating rotators 102 and 192. In this case, the surfaces of the heating rotators 102 and 192 are less abraded.

Although it is configured that the cross-sectional shape in the pressure area S is convex on the pressure roll (or pressure belt) side on both ends in the axial direction of the heating rotator and is flat in the center in the axial direction in this exemplary embodiment, the cross-sectional shape is not limited to this. The cross-sectional shape in the pressure area S may be convex on the heating rotator side. This is adjusted by appropriately selecting the shape and the rigidity of the pressure roll and the pressure pad.

Also, in the fixing device 190, the foamed sponge elastic layer may be provided on the pressure belt 182 and the cap member 196 and the gear 198 may be integrally formed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating rotator that is used for heating a developer on a recording medium, the heating rotator comprising a cylindrical body that is made of a metal and both end portions of the cylindrical body being rotatably supported, the cylindrical body having a thick-walled portion on at least one of both end portions that is thicker than a center portion in an axial direction of the cylindrical body, and a cross-sectional shape of the heating rotator changing from the end portions toward the center portion in a pressure area of an outer peripheral surface to which pressure is applied by a pressure roll.

2. The heating rotator of claim 1, wherein the thick-walled portion is provided only on one of the end portions in the axial direction of the cylindrical body.

3. A fixing device comprising:

the heating rotator of claim 1;

a supporting structure that rotatably supports both end portions of the heating rotator;

a heating device that heats the heating rotator; and the pressure roll that, both end portions of the pressure roll being rotatably supported, applies pressure to the outer peripheral surface of the heating rotator, in which a member that contacts the heating rotator and receives pressure from the pressure roll is not present inside the heating rotator.

4. The fixing device of claim 3, wherein a driving force transmitting member that transmits a driving force is attached to the supporting structure.

5. The fixing device of claim 3, wherein the pressure roll has a foamed sponge elastic layer.

6. The fixing device of claim 3, wherein the pressure roll has an endless rotating member, and a pressure member provided inside the rotating member for, through the rotating member, applying pressure to the outer peripheral surface of the heating rotator and changing a cross-sectional shape of the heating rotator in an axial direction.

7. The fixing device of claim 3, wherein the heating device has a magnetic field generating unit that generates a magnetic field, and the heating rotator has a heat generating layer that generates heat by electromagnetic induction of the magnetic field.

8. The fixing device of claim 7, wherein the heating rotator has a supporting layer, comprising a temperature-sensitive magnetic metal, that supports the heat generating layer.

9. The fixing device of claim 7, wherein the heating rotator has a protecting layer that protects the heat generating layer from oxidation.

10. An image forming device comprising:

the fixing device of claim 3;

an exposure unit that emits exposure light;

a developing unit that develops a latent image formed by the exposure light by using a developer to form a developer image;

a transferring unit that transfers the developer image onto a recording medium; and a conveyance unit that conveys the recording medium, to which the developer image has been transferred, to the fixing device.

11. The heating rotator of claim 1, wherein the thick-walled portion is provided on both ends in the axial direction of the cylindrical body.

12. The heating rotator of claim 1, wherein the thick-walled portion is formed such that an outer surface of the cylindrical body is raised outwardly.

13. The heating rotator of claim 1, wherein the thick-walled portion is formed such that an inner surface of the cylindrical body protrudes inwardly.

14. A fixing device comprising:

a heating rotator that is used for heating a developer on a recording medium, the heating rotator including a cylindrical body that is made of a metal and both end portions of the cylindrical body being rotatably supported, the cylindrical body having a thick-walled portion on at least one of both end portions that is thicker than a center portion in an axial direction of the cylindrical body, and a cross-sectional shape perpendicular to the axial direction of the heating rotator changes from the end portions toward the center portion;

a supporting structure that rotatably supports both end portions of the heating rotator;

a heating device that heats the heating rotator; and a pressure roll that applies pressure to an outer peripheral surface of the heating rotator, both end portions of the pressure roll being rotatably supported.

15. The fixing device of claim 14, wherein the pressure roll applies pressure to the outer peripheral surface of the heating rotator, and wherein a member that contacts an inner surface of the heating rotator and receives pressure from the pressure roll is not present inside the heating rotator.

16. The fixing device of claim 14, wherein the supporting structure rotatably supports the cylindrical body through a supporting member that fits inside the thick-walled portion.

* * * * *